US007264765B2

(12) United States Patent
Ono et al.

(10) Patent No.: US 7,264,765 B2
(45) Date of Patent: Sep. 4, 2007

(54) METHOD AND APPARATUS FOR SMELTING TITANIUM METAL

(75) Inventors: Katsutoshi Ono, Tokyo (JP); Ryosuke Suzuki, Kyoto (JP)

(73) Assignee: Nippon Light Metal Company, Ltd., Tokyo (JP)

( * ) Notice: Subject to any disclaimer, the term of this patent is extended or adjusted under 35 U.S.C. 154(b) by 266 days.

(21) Appl. No.: 10/491,293

(22) PCT Filed: Oct. 11, 2002

(86) PCT No.: PCT/JP02/10588

§ 371 (c)(1),
(2), (4) Date: Mar. 31, 2004

(87) PCT Pub. No.: WO03/038156

PCT Pub. Date: May 8, 2003

(65) Prior Publication Data

US 2004/0237711 A1 Dec. 2, 2004

(30) Foreign Application Priority Data

Oct. 17, 2001 (JP) ..... 2001-319467

(51) Int. Cl.
*C22B 1/10* (2006.01)

(52) U.S. Cl. ..... 266/172; 266/171

(58) Field of Classification Search ..... 266/172, 266/168, 171

See application file for complete search history.

(56) References Cited

U.S. PATENT DOCUMENTS 2,939,823 A * 6/1960 Rand ..... 205/400
4,381,976 A * 5/1983 Armand ..... 205/400
5,089,094 A * 2/1992 Ogasawara et al. ..... 205/405

FOREIGN PATENT DOCUMENTS

| | | |
|---|---|---|
| JP | 32-2357 | 4/1957 |
| JP | 04-099829 | 3/1992 |
| JP | 2000-345252 | 12/2000 |

(Continued)

OTHER PUBLICATIONS

English Translation of International Preliminary Report for PCT/JP2002/010588 mailed on Jul. 1, 2004.

(Continued)

*Primary Examiner*—Scott Kastler
(74) *Attorney, Agent, or Firm*—Rader, Fishman & Grauer PLLC

(57) ABSTRACT

This invention relates to a method and an apparatus for smelting titanium metal by the thermal reduction of titanium oxide ($TiO_2$) to titanium metal (Ti); a mixed salt of calcium chloride ($CaCl_2$) and calcium oxide (CaO) contained in a reaction vessel is heated to form a molten salt which constitutes a reaction region, the molten salt in the reaction region is electrolyzed thereby converting the molten salt into a strongly reducing molten salt containing monovalent calcium ions ($Ca^+$) and/or calcium (Ca), titanium oxide is supplied to the strongly reducing molten salt and the titanium oxide is reduced and the resulting titanium metal is deoxidized by the monovalent calcium ions and/or calcium. The method and the apparatus make it feasible to produce commercially titanium metal suitable for a variety of applications from titanium oxide.

4 Claims, 14 Drawing Sheets

FOREIGN PATENT DOCUMENTS

WO WO-99/64638 12/1999

OTHER PUBLICATIONS

International Search Report for PCT/JP02/10588 mailed on Jan. 28, 2003.
Titanium, vol. 50 No. 2, Apr. 2002, pp. 105-108.
Current Advances in Materials and Processes, vol. 15 (2002) No. 3 , p. 628, Dec. 2002.
JOM vol. 54, No. 2, Feb. 2002, pp. 59-61.
Materia Japan, vol. 41 (1) 2002, pp. 28-31, Dec. 2002.
Bulletin of the Iron and Steel Institute of Japan (Ferrum), vol. 7 (2002) No. 1, pp. 39-45, Dec. 2002.
EPD Congress 2001, "A Process for Continuous Titanium Production form Titanium Oxide", pp. 79-88, Dec. 2001.
Journal of the Japan Inst. Metals, vol. 28 (1964) No 9, pp. 549-554, Dec. 1964.

* cited by examiner

METHOD AND APPARATUS FOR SMELTING TITANIUM METAL

FIELD OF TECHNOLOGY

This invention relates to a method for smelting titanium metal which is based on the thermal reduction of titanium oxide ($TiO_2$) to titanium metal (Ti) and is commercially feasible for mass production and to an apparatus therefor.

BACKGROUND TECHNOLOGY

Titanium metal has revealed its attractive properties one after another and it has been put to commercial use not only in the aircraft and spacecraft industries for many years but also in consumer goods such as cameras, glasses, watches and golf clubs in recent years; still more, titanium metal is expected to create a demand in the industrial sectors of construction materials and automobiles.

At the present time, the only method available for the commercial production of titanium metal is the so-called Kroll process with the exception of an electrolytic process employed on an extremely small scale for the production of high-purity titanium for use in semiconductors.

The smelting of titanium metal by the Kroll process is performed in the manner shown in FIG. 13.

In the first stage (S1), the raw material titanium oxide ($TiO_2$) is allowed to react with chlorine gas ($Cl_2$) at 1000° C. in the presence of carbon (C) to give titanium tetrachloride ($TiCl_4$) with a low boiling point of 136° C. (chlorination: S101) and the titanium tetrachloride thus obtained is refined by distillation thereby removing impurities such as iron (Fe), aluminum (Al) and vanadium (V) and raising the purity of titanium tetrachloride (refining by distillation: S102); the formation of titanium tetrachloride involves the following reactions;

$$TiO_2+C+2Cl_2=TiCl_4+CO_2$$

$$TiO_2+2C+2Cl_2=TiCl_4+2CO$$

In the second stage (S2), titanium tetrachloride is reduced to titanium metal in the presence of magnesium metal (Mg) (reduction: S201). The reduction is conducted by introducing magnesium metal to a hermetically sealed iron vessel, melting the magnesium metal at 975° C. and adding titanium tetrachloride in drops to the molten magnesium metal. Titanium metal forms according to the following reaction formula:

$$TiCl_4+2\ Mg=Ti+2MgCl_2$$

The titanium metal obtained by the reduction of titanium tetrachloride normally occurs as a large lump reproducing the inner shape of the apparatus used for the reduction reaction, for example, as a cylindrical lump; it is a porous solid or the so-called titanium metal sponge and contains the byproduct magnesium chloride and the unreacted magnesium metal; generally, the center of the sponge has dissolved oxygen on the order of 400-600 ppm and is tough while the skin has dissolved oxygen on the order of 800-1000 ppm and is hard.

This titanium metal sponge is then subjected to vacuum separation where the sponge is heated at 1000° C. or above under reduced pressure of $10^{-1}$-$10^{-4}$ Torr to separate the byproduct magnesium chloride ($MgCl_2$) and the unreacted magnesium metal (vacuum separation: S202).

The magnesium chloride thus recovered by the vacuum separation is decomposed by electrolysis into magnesium metal and chlorine gas ($Cl_2$) (electrolysis: S203), the magnesium metal recovered here is utilized, together with the unreacted magnesium metal recovered earlier in the vacuum separation (not shown), in the aforementioned reduction of titanium tetrachloride while the recovered chlorine gas is utilized in the aforementioned chlorination of titanium oxide.

In the third stage (S3) where this titanium metal sponge is converted into the product titanium ingot by the consumable-electrode arc melting method, the sponge formed as a large lump is crushed and ground (crushing and grinding treatment) in advance for the preparation of primary electrode briquettes. If circumstances require, the ground sponge is sorted out in consideration of the purpose of use of ingot and the difference in the concentration of dissolved oxygen by site (center or skin); for example, the ground sponge originating mainly from the center is collected in the case where tough titanium metal is required while the ground sponge originating mainly from the skin is collected in the case where hard titanium metal is required.

The ground titanium metal sponge prepared in this manner is then molded into briquettes in the compression molding step (compression molding: S301) and a plurality of the briquettes are placed one upon another and welded together by the TIG welding process to yield a cylindrical electrode; thereafter the electrode is melted by vacuum arc melting, high frequency melting and the like (melting: S302) and an oxide skin on the surface is cut off to yield the product titanium ingot.

However, the smelting of titanium metal by the aforementioned Kroll process incurs an exceptionally high production cost mainly from the following causes: titanium oxide, although used as the raw material, is first converted into low-boiling titanium tetrachloride and then reduced and this procedure extends the manufacturing step; vacuum separation at high temperatures is an essential step in the manufacture of titanium metal sponge; moreover, titanium metal sponge occurring as a large lump must be crushed and ground in the manufacture of the product titanium ingot; still more, the sponge differs markedly in the concentration of dissolved oxygen between the center and the skin and the ground sponge needs to be sorted out to the one originating from the center and that from the skin depending upon the use of the product titanium ingot.

Now, several methods other than the aforementioned Kroll process have been proposed for smelting titanium metal.

For example, Sakae Takeuchi and Osamu Watanabe [J. Japan Inst. Metals, Vol. 28, No. 9, 549-554 (1964)] describe a method illustrated in FIG. 14 for producing titanium metal; a reactor consists of a graphite crucible a as an anode and a molybdenum electrode b in the center as a cathode, a mixed molten salt c which is composed of calcium chloride ($CaCl_2$), calcium oxide (CaO) and titanium oxide ($TiO_2$) and kept at 900-1100° C. is charged into the crucible a, the titanium oxide is electrolyzed in an inert atmosphere of argon (not shown) and the titanium ions formed ($Ti^{4+}$) are deposited on the surface of molybdenum electrode b to give titanium metal d.

Another method described in WO 99/64638 is illustrated in FIG. 15: molten calcium chloride c ($CaCl_2$) is charged into a reaction vessel, a graphite electrode a as an anode and a titanium oxide electrode b as a cathode are arranged inside the molten salt c and a voltage is applied between the graphite electrode a and the titanium oxide electrode b thereby extracting oxygen ions ($O^{2-}$) from the titanium oxide cathode b and releasing the oxygen ions as carbon dioxide ($CO_2$) and/or oxygen ($O_2$) at the graphite anode a or reducing the titanium oxide electrode b itself to titanium metal d.

However, according to the method described in the paper of Takeuchi and Watanabe, the deposited titanium metal d is kept in continuous contact with calcium oxide of high concentration in the mixed molten salt c and this makes it difficult to produce titanium metal d of excellent toughness by controlling or lowering the concentration of dissolved oxygen in the titanium metal d being produced; moreover, titanium metal forms fine tree-shaped deposits on the surface of the molybdenum electrode b and this makes the mass production difficult. Thus, it is questionable whether the method of Takeuchi and Watanabe is suitable as a commercial method or not. On the other hand, the method described in WO 99/64638 has the following problem; the deoxidization requires a long time because oxygen is present in a small amount in the titanium metal d formed at the cathode and its diffusion in solid becomes the rate-determining step.

The inventors of this invention have conducted studies on a method and apparatus for smelting titanium metal which, unlike the Kroll process, can easily produce titanium metal without requiring the steps for vacuum separation at high temperatures and crushing and grinding of titanium metal sponge and additionally can control easily the concentration of dissolved oxygen in the product titanium metal.

Consequently, the inventors of this invention have found it possible to produce titanium metal (Ti) continuously by the thermal reduction of titanium oxide in the following manner: a molten salt consisting of calcium chloride ($CaCl_2$) and calcium oxide (CaO) was prepared as a reaction region inside a reaction vessel, the molten salt in the reaction region was electrolyzed to generate monovalent calcium ions ($Ca^+$) and/or calcium (Ca) thereby converting the molten salt into a strongly reducing molten salt, titanium oxide ($TiO_2$) was supplied to the strongly reducing molten salt and the titanium oxide was reduced and the resulting titanium metal was deoxidized by the monovalent calcium ions ($Ca^+$) and/or calcium (Ca). The inventors have further found it possible not only to produce titanium metal advantageously on a commercial scale but also to control the concentration of dissolved oxygen in titanium metal and completed this invention.

Accordingly, an object of this invention is to provide a method for smelting titanium metal which is capable of producing titanium metal commercially advantageously.

Another object of this invention is to provide a method for smelting titanium metal which is capable of producing titanium metal with a controlled concentration of dissolved oxygen commercially advantageously.

A further object of this invention is to provide an apparatus for smelting titanium metal which is capable of producing titanium metal commercially advantageously.

A still further object of this invention is to provide an apparatus for smelting titanium metal which is capable of producing titanium metal with a controlled concentration of dissolved oxygen commercially advantageously.

DISCLOSURE OF THE INVENTION

Thus, this invention relates to a method for smelting titanium metal which is based on the thermal reduction of titanium oxide ($TiO_2$) to titanium metal (Ti) and comprises charging a mixed salt of calcium chloride ($CaCl_2$) and calcium oxide (CaO) into a reaction vessel, heating the mixed salt to prepare a molten salt consituting a reaction region, electrolyzing the molten salt in the reaction region thereby converting the molten salt into a strongly reducing molten salt containing monovalent calcium ions ($Ca^+$) and/or calcium (Ca), supplying titanium oxide to the strongly reducing molten salt and reducing the titanium oxide and deoxidizing the resulting titanium metal by the monovalent calcium ions ($Ca^+$) and/or calcium (Ca).

This invention further relates to a method for smelting titanium metal wherein the reaction region constituted by the aforementioned molten salt is divided into an electrolysis zone where the molten salt is electrolyzed and a reduction zone where the titanium oxide is reduced and the resulting titanium metal is deoxidized.

This invention further relates to an apparatus for smelting titanium metal by the thermal reduction of titanium oxide ($TiO_2$) to titanium metal (Ti) and comprises a reaction vessel for holding a molten salt of calcium chloride ($CaCl_2$) and calcium oxide (CaO) constituting a reaction region, an anode and a cathode which are put in place at a specified interval in the reaction vessel and used in the electrolysis of the molten salt, a gas-introducing device to maintain a part or the whole of the upper part of the reaction region in an atmosphere of inert gas and a raw material supply device from which titanium oxide is supplied to the reaction region in an atmosphere of inert gas.

This invention still further relates to an apparatus for smelting titanium metal wherein the aforementioned reaction vessel is divided into an electrolysis zone where the molten salt is electrolyzed and a reduction zone where titanium oxide is reduced and the resulting titanium metal is deoxidized and a partitioning device is provided which allows the monovalent calcium ions ($Ca^+$) and/or calcium (Ca) generated in the electrolysis zone to migrate to the reduction zone and allows the calcium oxide (CaO) formed in the reduction zone to migrate to the electrolysis zone.

According to this invention, titanium oxide prepared by whatever method available can be used as the raw material: as for the purity, the impurities in the raw material titanium oxide are preferably controlled within the range allowable for the product titanium ingot because these impurities remain behind in the ingot; as for the shape, unlike the case where titanium oxide is used as the raw material of white pigments and the like, there is no specific restriction on the crystal form, particle diameter, shape, surface condition and the like. Titanium oxide intended for use in coatings, pigments and the like are generally controlled precisely in particle size and is available as high-purity white particles with an average particle diameter of 1 μm or less. By comparison, titanium oxide to be used in this invention is not necessarily uniform in particle diameter and the requirements for purity and shape are less severe, say, a purity of 99.7% by weight and no particular uniformity in particle diameter, and this makes it less costly to obtain the raw material titanium oxide.

According to this invention, a molten salt consisting of calcium chloride ($CaCl_2$) and calcium oxide (CaO) and/or calcium (Ca) and usually kept at 750-1000° C. is used as a reaction medium constituting the reaction region for the reduction of titanium oxide. The molten salt constituting this reaction region may consist of calcium chloride ($CaCl_2$) alone at the start of electrolysis and, in such a case, the electrolysis of calcium chloride generates monovalent calcium ions ($Ca^+$) and electrons (e) and the formation of calcium oxide (CaO) and calcium (Ca) occurs immediately thereafter. The range where calcium and calcium oxide exist in the molten salt is normally 1.5% by weight or less for calcium and 11.0% by weight or less for calcium oxide; for example, when the mixed molten salt exists at a temperature of 900° C., calcium exists in the range of 0.5-1.5% by weight and calcium oxide in the range of 0.1-5.0% by weight.

Further, according to this invention, the monovalent calcium ions ($Ca^+$) and electrons (e) generated by the electrolysis of the aforementioned molten salt, particularly, the monovalent calcium ions ($Ca^+$) and calcium (Ca) generated immediately thereafter are used as a reducing agent and a deoxidizing agent of titanium oxide. Here, the composition of the molten salt is adjusted in consideration of the concentration of dissolved oxygen in the titanium metal to be produced. A higher concentration ratio Ca/CaO in the molten salt increases the ability to perform reduction and deoxidization but decreases the ability to electrolyze calcium oxide. The concentrations of Ca and CaO can be adjusted, for example, by controlling the strength of electric current in the electrolysis and the rate of supply of the raw material titanium oxide.

Still further, according to this invention, the reaction region constituted by the aforementioned molten salt is divided into an electrolysis zone where the molten salt is electrolyzed and a reduction zone where titanium oxide is reduced and the resulting titanium metal is deoxidized; the molten salt is electrolyzed in the electrolysis zone to generate monovalent calcium ions ($Ca^+$) and/or calcium (Ca) to be used as a reducing agent in the reduction of titanium oxide and as a deoxidizing agent in the deoxidization of the resulting titanium metal and the monovalent calcium ions ($Ca^+$) and/or calcium (Ca) generated in the electrolysis zone reduce titanium oxide to titanium metal and remove oxygen dissolved in the titanium metal in the reduction zone.

A device for dividing the aforementioned reaction region into the electrolysis zone and the reduction zone allows the monovalent calcium ions ($Ca^+$) and/or calcium (Ca) generated in the electrolysis zone to migrate to the reduction zone and allows the calcium oxide formed in the reduction zone to migrate to the electrolysis zone and there is no specific restriction on the device as long as it preferably prevents the raw material titanium oxide supplied to the reduction zone and the titanium metal formed in the reduction zone from migrating to the electrolysis zone. For example, the following constructions are conceivable; to provide a partition wall or the like between the two zones, to construct the electrolysis zone and/or the reduction zone by an electrolysis reaction vessel and/or a reduction reaction vessel, to utilize a cathode material as a partition in constructing a cathode face to face with an anode in the electrolysis zone, or to mark off the reduction zone in the center of the reaction region and arrange a cathode material to form the electrolysis zone on both sides of or in the periphery of the reduction zone.

According to this invention, the anode in the aforementioned electrolysis zone is made of a carbonaceous anode material such as graphite, coke and pitch and it captures oxygen evolving in the electrolysis of calcium oxide in the molten salt and releases it from the reaction region as carbon monoxide and/or carbon dioxide. The carbonaceous anode material used here preferably forms a slope shaped like an overhang at least in the portion to be immersed in the molten salt; this will allow carbon dioxide formed on the surface of this carbonaceous anode material to rise along the overhang-shaped slope and escape from the system without unnecessarily dispersing in the molten salt.

According to this invention, when titanium oxide is supplied to the molten salt in the reduction zone, this titanium oxide is reduced instantaneously by the monovalent calcium ions in the molten salt and the titanium metal particles formed descend while agglomerating and sintering; during the descent, the amorphous titanium metal particles join together loosely, grow into a coarse porous lump with a size ranging from several millimeters to several tens of millimeters (the so-called titanium metal sponge) and accumulate at the bottom of the reduction zone (or at the bottom of the reduction reaction vessel).

The titanium metal recovered from the reduction zone is washed with water and/or dilute hydrochloric acid for removal of calcium chloride and calcium oxide adhered to the surface. Washing of titanium metal by water and/or acid is carried out, for example, by a combination of a step for dissolving the adhered salts in a washing tank by applying high-pressure water and a step for recovering titanium metal by a wet cyclone and the like.

The titanium metal produced in the aforementioned manner is, similarly to the conventional Kroll process, molded into an electrode in the compression molding step and then submitted to the melting step such as vacuum arc melting and high frequency melting and the skin of the molten ingot is adjusted to give the product titanium ingot.

This invention is described concretely below with reference to a flow chart illustrating the basic principle of the invention, schematic drawings of apparatuses and graphs.

FIG. 1 is a flow chart illustrating the method of this invention for smelting titanium metal and FIG. 2 is a schematic drawing of the apparatus used in the method for smelting titanium metal of this invention.

As illustrated in FIG. 2, the smelting apparatus of this invention comprises a reaction vessel 1, a molten salt which is prepared by heating a mixture of calcium chloride ($CaCl_2$) and calcium oxide (CaO) at 750-1000° C. and put in the reaction vessel 1 to constitute a reaction region 2, an anode 3 and a cathode 4 which are put in place facing each other in the reaction region 2 and connected to a direct current source 5 to effect the electrolysis of the molten salt ($CaCl_2$ and/or CaO) and a raw material inlet 6 which is positioned away from the anode 3 with the cathode 4 in between and supplies the raw material titanium oxide to the reaction region 2. In conception, the reaction region 2 consists of an electrolysis zone where the electrolysis is effected by the anode 3 and cathode 4 and a reduction zone where titanium oxide supplied from the raw material inlet 6 is reduced and the resulting titanium metal is deoxidized. Preferably, the anode 3 is made of a consumable carbonaceous anode material such as graphite, coke and pitch and the cathode 4 is made of a nonconsumable cathode material such as iron and titanium.

The smelting of titanium metal by the use of the reaction vessel 1 is performed as follows. First, a mixture of calcium chloride ($CaCl_2$) and calcium oxide (CaO) is charged into the reaction vessel 1 and melted at 750-1000° C. to yield a molten salt which constitutes the reaction region 2. Here, calcium chloride ((②) in FIG. 2) functions as a solvent. The calcium ions of calcium chloride is divalent stoichiometrically, but monovalent calcium ions ($Ca^+$) also exist in the molten calcium chloride and a molten salt in which these monovalent calcium ions ($Ca^+$) exist forms a homogeneous liquid phase of a three-component system $CaCl_2$—CaO—Ca.

The molten salt constituting the reaction region 2 may consist of calcium chloride alone at the start of the electrolysis and, in such a case, calcium chloride is electrolyzed to generate monovalent calcium ions ($Ca^+$) and electrons (e) and a part of the monovalent calcium ions forms calcium oxide (CaO) and calcium (Ca) immediately after the start of the electrolysis.

The ranges of existence of calcium and calcium oxide in the molten salt constituting the reaction region 2 are normally 1.5% by weight or less for calcium and 11.0% by weight or less for calcium oxide; for example, when the temperature of the molten salt is 900° C., the range for calcium is 0.5-1.5% by weight and that for calcium oxide is 0.1-5.0% by weight. The monovalent calcium ions in the molten salt are used as a reducing agent and deoxidizing agent of titanium oxide and here the composition of the molten salt is adjusted in consideration of the concentration of dissolved oxygen in the titanium metal to be produced; a higher concentration ratio Ca/CaO in the molten salt increases the ability to perform reduction and deoxidization but decreases the ability to perform electrolysis. The concentrations of Ca and CaO are adjusted, for example, by controlling the strength of electric current used for the electrolysis and the rate of supply of the raw material titanium oxide.

The electrolysis of the aforementioned molten salt generates monovalent calcium ions ($Ca^+$) and/or calcium (Ca) thereby converting the molten salt into a strongly reducing molten salt and, after the start of the reduction of titanium oxide and deoxidization of the resulting titanium metal, makes up for the monovalent calcium ions ($Ca^+$) and/or calcium (Ca) consumed in the reduction and deoxidization. Normally, the electrolysis is conducted at a direct current voltage below the decomposition voltage of calcium chloride (for example, 3.0 V or so) and, as shown by reaction formula ③ in FIG. 2 or reaction formula (1) below, the electrons supplied from the cathode 4 made of a nonconsumable electrode material reduce the divalent calcium ions ($Ca^{2+}$) in the molten salt to monovalent calcium ions and, when the monovalent calcium ions reach their solubility in the molten salt, pure calcium (Ca) starts to separate out.

$$\text{Cathode: } Ca^{2+} + e = Ca^+ \quad (1)$$

$$Ca^{2+} + 2e = Ca \quad (2)$$

$$Ca^+ + e = Ca \quad (3)$$

Furthermore, as described above, it is possible to effect the electrolysis of calcium chloride itself and at the same time cause the same reactions as those described by the aforementioned reaction formulas (1) to (3) by increasing at will the potential to be applied to the electrodes employed for the electrolysis. These reactions may be regarded as simultaneous electrolytic decomposition reactions of calcium chloride and calcium oxide because the theoretical decomposition voltage of calcium oxide is lower than that of calcium chloride.

As the electrolysis of the molten salt proceeds in the molten salt constituting the reaction region 2 in this manner, the molten salt in the reaction region 2 becomes a strongly reducing molten salt due to the existence therein of the monovalent calcium ions ($Ca^+$) and/or calcium (Ca) and titanium oxide ($TiO_2$, ① in FIG. 2) supplied from the raw material inlet 6 to the reaction region 2 is reduced by the monovalent calcium ions and/or calcium in accordance with reaction formulas ⑤ and ⑥ in FIG. 2 or reaction formulas (4) and (5) below and dissolved oxygen ($[O]_{Ti}$) in the titanium metal formed is removed.

$$TiO_2+2Ca^++2e=Ti+2Ca^{2+}+2O^{2-} \quad (4)$$

$$[O]_{Ti}+Ca^++e=Ca^{2+}+O^{2-} \quad (5)$$

As the reduction reaction of titanium oxide and the deoxidization reaction of the resulting titanium metal proceed in the molten salt in the reaction region 2, the monovalent calcium ions ($Ca^+$) near the titanium particles decrease in concetration as they are consumed and, contrarily, the oxygen ions ($O^{2-}$) increase in concentration and so does calcium oxide (CaO).

That is, in the electrolysis zone where the anode 3 and the cathode 4 exist, monovalent calcium ions ($Ca^+$) and electrons (e) are first generated by the electrolysis of the molten salt and the monovalent calicum ions ($Ca^+$) and/or calcium (Ca) then diffuse into the reduction zone in the reaction region 2; in the reduction zone where the raw material inlet 6 is provided, the monovalent calcium ions ($Ca^+$) and/or calcium (Ca) are consumed and calcium oxide (CaO) and oxygen ions ($O^{2-}$) increase in concentration and diffuse into the electrolysis zone; the calcium oxide is again electrolyzed at the cathode 4 to form monovalent calcium ions ($Ca^+$) and/or calcium (Ca) and the oxygen ions react with carbon at the anode 3 made of a consumable carbonaceous anode material in accordance with the following reaction formulas (6) and (7) to give carbon monoxide (CO) and carbon dioxide ($CO_2$), designated as ④ in FIG. 2, to be discharged from the system.

$$\text{Anode: } C+O^{2-}=CO+2e \quad (6)$$

$$C+2O^{2-}=CO_2+4e \quad (7)$$

In this manner, titanium oxide is continuously supplied from the raw material inlet 6 to the molten salt in the reaction region 2 and reduced during its descent through the strongly reducing molten salt and the resulting titanium metal is deoxidized; from the point of time when the titanium oxide phase changes into the titanium metal phase, titanium particles grow in size by agglomeration and a slurry containing a high density of the titanium particles with a particle diameter of 0.1-1 mm accumulates at the bottom of the reaction vessel 1. The deoxidization reaction of the titanium particles proceeds also in the slurry in accordance with reaction formula ⑥ in FIG. 2 or reaction formula (5) described above.

The equilibrium concentration of oxygen which dissolves in titanium when titanium metal (Ti) exists in equilibrium with pure calcium (Ca) and calcium oxide (CaO) is illustrated in FIG. 3. This concentration of dissolved oxygen represents the limit of deoxidizing titanium by pure calcium (activity $a_{Ca}=1$) or it is the ultimate oxygen concentration in the reduction of titanium oxide ($TiO_2$) by pure calcium. For example, it is 500 ppm or less at 1000° C. as illustrated in FIG. 3. When calcium in molten calcium chloride ($CaCl_2$) exceeds its solubility and a part of it separates out as liquid, rises to the surface and exists there as an independent phase and calcium oxide formed as a byproduct in the reduction of titanium oxide is diluted by calcium chloride, the ultimate concentration of dissolved oxygen in titanium is a function of the concentration of calcium oxide and varies as illustrated in FIG. 4. In FIG. 4, the degree of dilution of calcium by calcium oxide is expressed in terms of the activity ratio r ($=a_{Ca}/a_{CaO}$) and the concentration of dissolved oxygen in titanium decreases sharply as the activity ratio r increases.

Moreover, the electrolysis of calcium oxide in calcium chloride between the anode 3 made of a consumable carbonaceous anode material and the cathode 4 made of a nonconsumable cathode material forms calcium-saturated calcium chloride either saturated with dissolved calcium or coexisting with pure calcium in the vicinity of the cathode 4. The theoretical decomposition voltage $E^O$ here can be expressed as a function of temperature as illustrated in FIG. 5. In this invention, the electrolysis of calcium oxide plays a part of reducing divalent calcium ions ($Ca^{+2}$) of calcium oxide in calcium chloride to monovalent calcium ions ($Ca^{+}$), diffusing the monovalent calcium ions into the molten salt and making up for the monovalent calcium ions consumed in the reduction and deoxidization of titanium oxide thereby practically restoring the concentration of calcium to saturation, that is, plays a part of maintaining the strongly reducing molten salt and does not necessarily aim at preparing pure calcium. Liquid calcium may separate out when the rate of generation of the monovalent calcium ions in the electrolysis exeeds the rate of consumption of the monovalent calcium ions in the reduction and deoxidization of titanium oxide; however, this does not cause inconvenience in the smelting of titanium according to this invention.

The titanium metal prepared in the aforementioned manner is normally taken out of the reaction vessel 1 as titanium metal sponge or as a slurry of the sponge and submitted to washing with water and dilute hydrochloric acid as illustrated in FIG. 1. The washing of titanium metal with water is carried out by cooling titanium metal, throwing the metal in water and agitating; titanium metal precipitates while calcium chloride adhering to the metal dissolves in water and calcium oxide forms a suspension of calcium hydroxide in water. In the washing of titanium metal with dilute hydrochloric acid, the calcium compounds adhering to the metal dissolve in the acid and are then removed by washing with water.

The titanium metal dried after washing with water and dilute hydrochloric acid is molded by compression into a briquette by a means such as a press; the briquette is either made into the product titanium ingot by electron beam melting or fabricated into an electrode, melted by vacuum arc melting or high frequency melting and adjusted for the cast skin to yield the product titanium ingot.

PREFERRED EMBODIMENTS OF THE INVENTION

Preferred modes of practicing this invention are described concretely below with reference to the accompanying examples.

EXAMPLE 1

Figure 1:
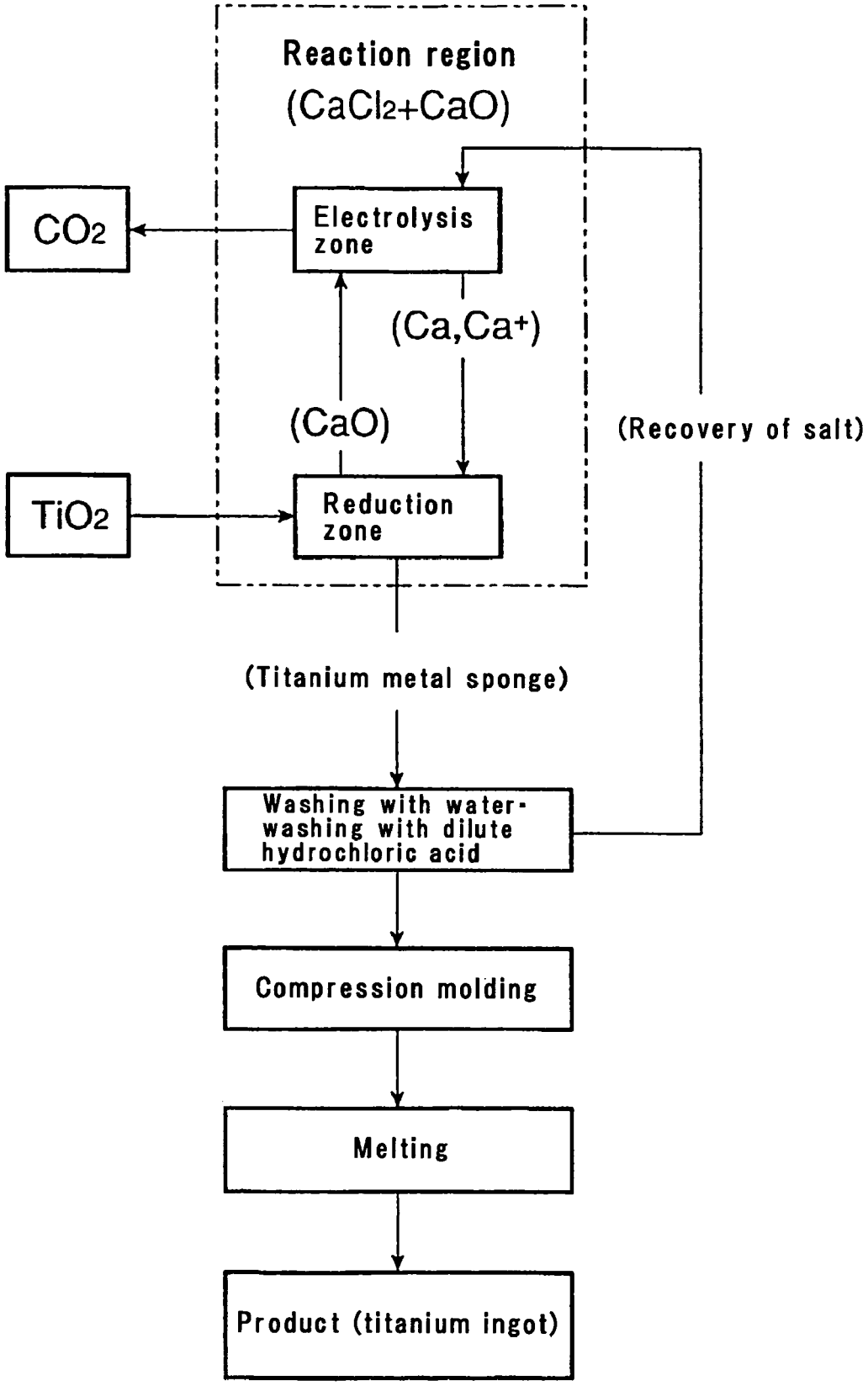
FIG. 1 is a flow chart illustrating the principle of the method for smelting titanium metal according to this invention.
Figure 2:
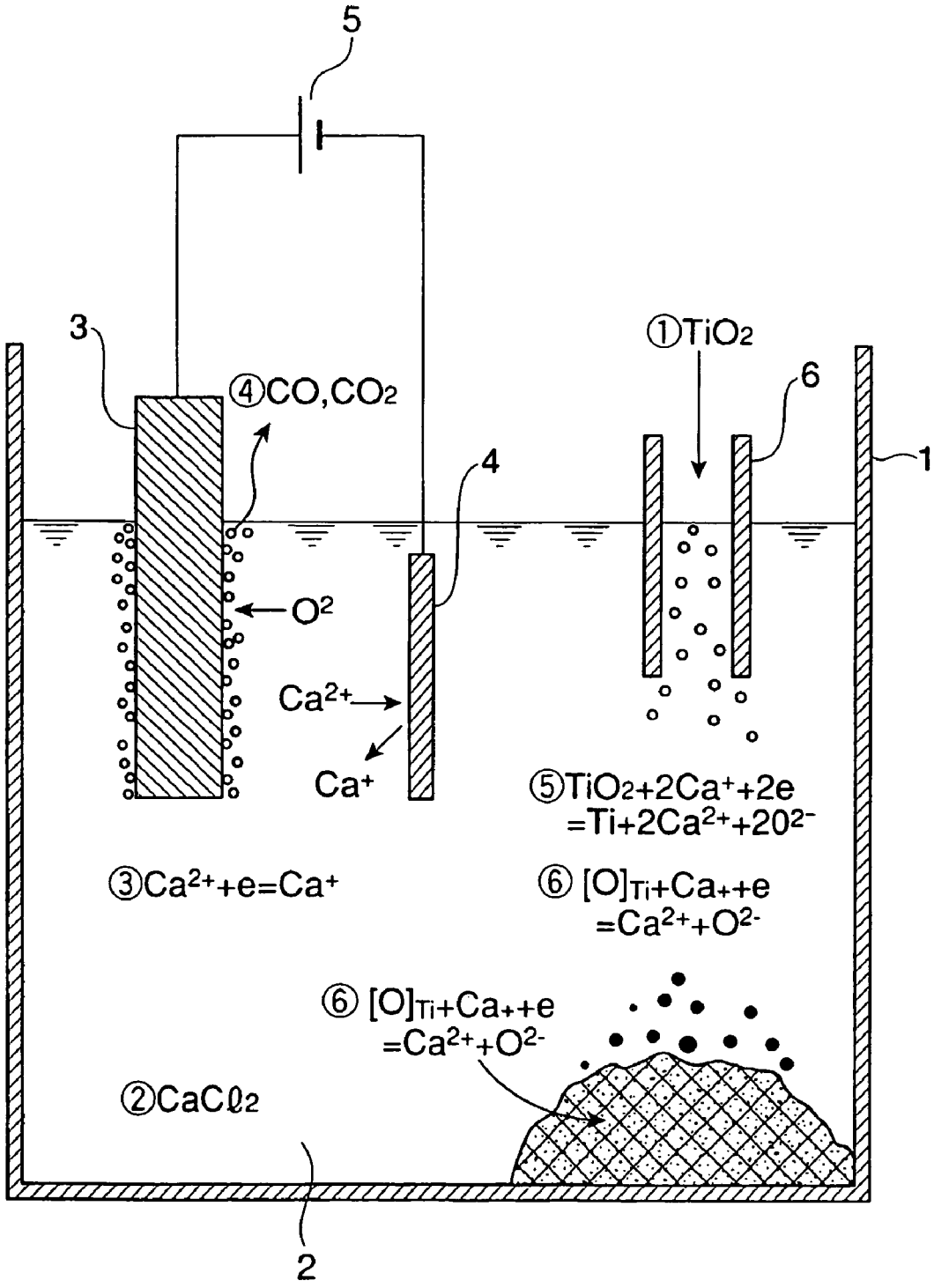
FIG. 2 is a schematic diagram explaining the method and apparatus for smelting titanium metal according to this invention.
Figure 3:
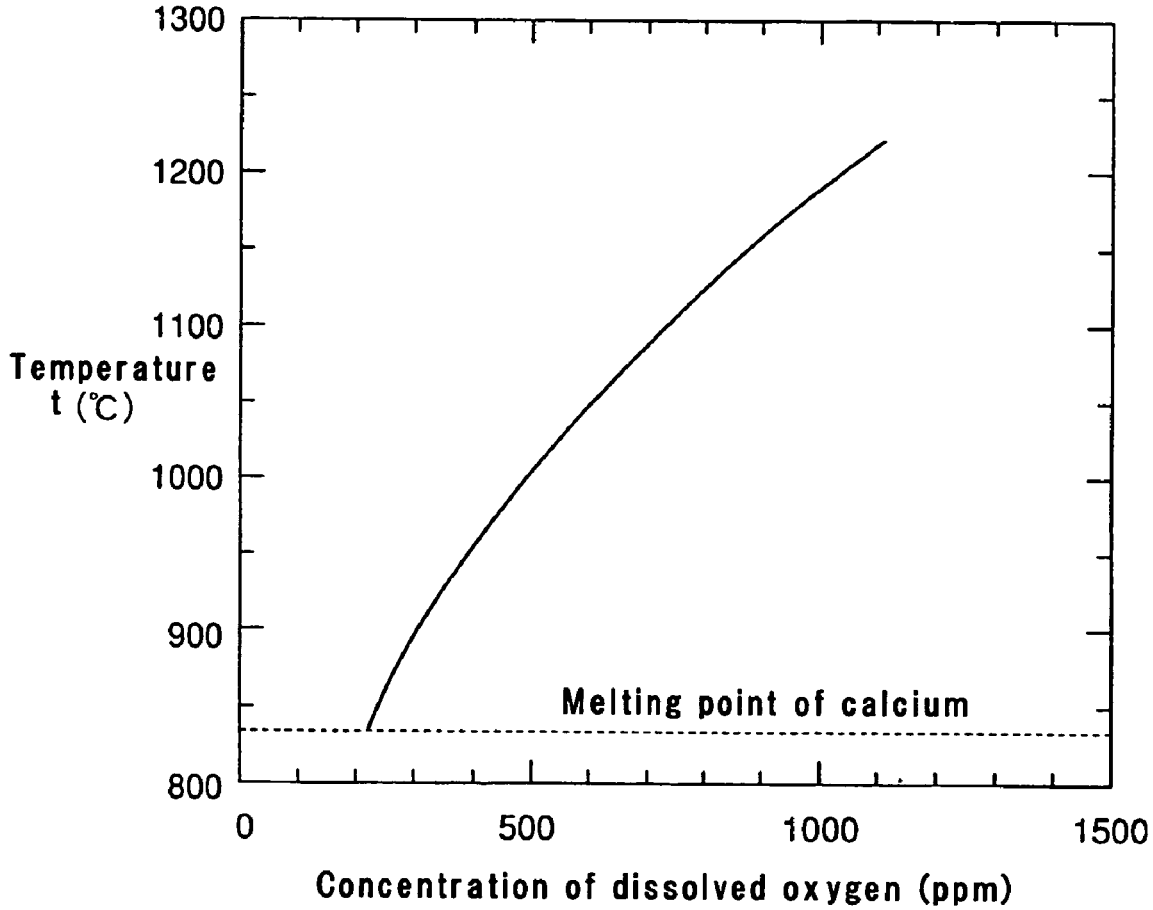
FIG. 3 is a graph of the relationship between concentration of dissolved oxygen and temperature in the ternary equilibrium of $CaCl_2$—CaO—Ca.
Figure 4:
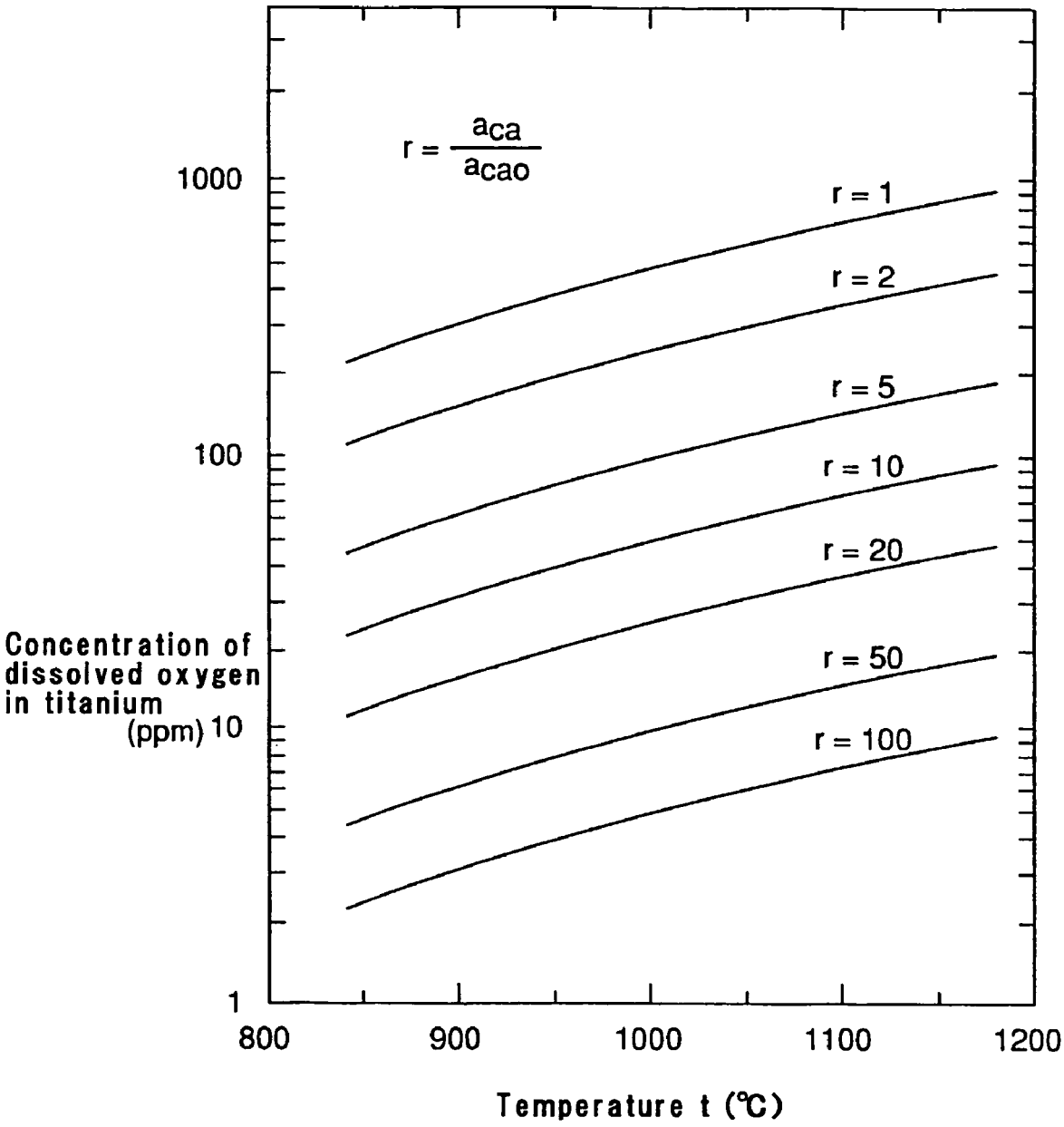
FIG. 4 is a graph of the activity ratio of calcium to calcium oxide in molten calcium chloride expressed in terms of the relationship between temperature and concentration of dissolved oxygen in titanium.
Figure 5:
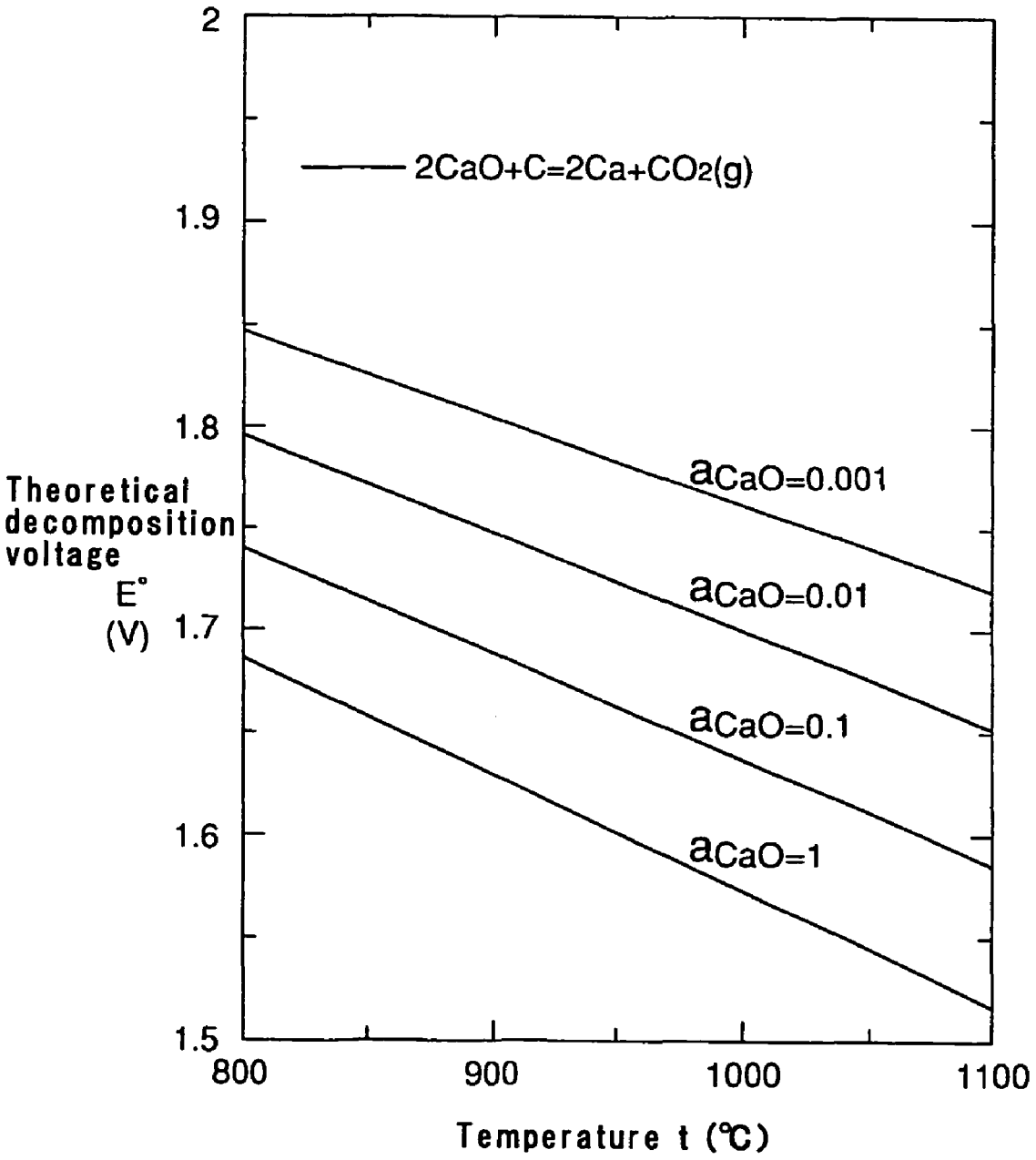
FIG. 5 is a graph of the activity of calcium in molten calcium chloride expressed in terms of the relationship between temperature and theoretical decomposition voltage.
Figure 6:
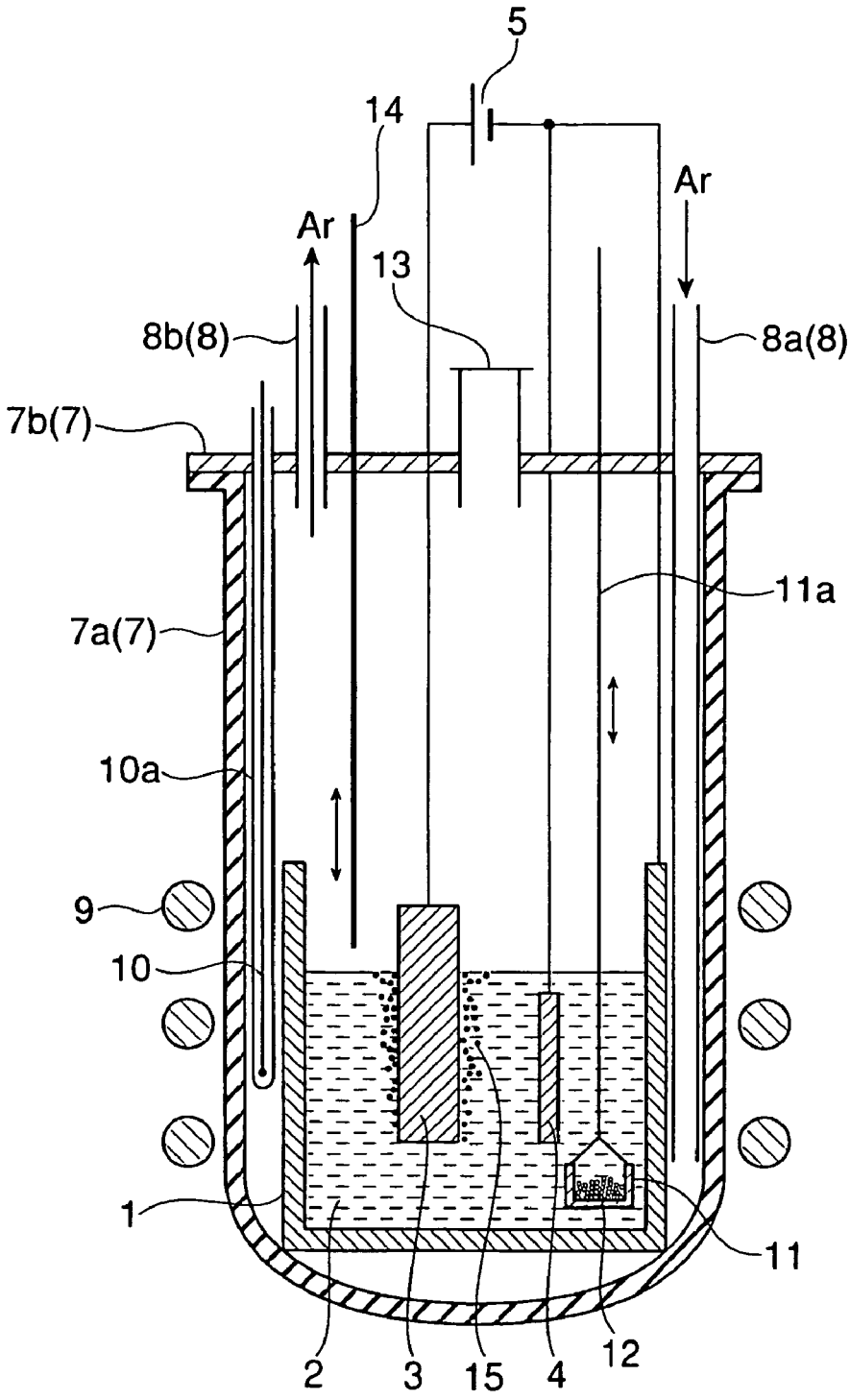
FIG. 6 is a schematic cross section diagram of the apparatus for smelting titanium metal related to Example 1 of this invention.

FIG. 6 is a schematic diagram illustrating in outline the apparatus of this invention for smelting titanium metal related to Example 1.

The smelting apparatus in Example 1 performs the smelting of titanium in the coexistence of an electrolysis zone and a reduction zone in a reaction region 2 and is equipped with a reaction vessel 1 (a vessel made of stainless steel) containing a molten salt consisting of calcium chloride ($CaCl_2$) and calcium oxide (CaO), an airtight vessel 7 holding the reaction vessel 1, a gas-introducing device 8 provided in the airtight vessel 7 for introducing an inert gas such as argon (Ar) to the inside of the aritight vessel 7, and an anode 3 that is a consumable carbonaceous anode material made of a graphite plate and a cathode 4 that is a cathode material made of iron arranged in the molten salt in the reaction vessel 1.

The aforementioned airtight vessel 7 consists of a main body 7*a* which is made of alumina and holds the reaction vessel 1 and a cover 7*b* which is made of stainless steel and closes the open end of the main body 7*a* and the aforementioned gas-introducing device 8 is provided in the cover 7*b* and consists of a gas inlet 8*a* and a gas outlet 8*b*. Furthermore, an electric furnace heating element 9 for heating the molten salt is arranged around the lower part of the main body 7*a* and a thermocouple 10 enclosed in a protective tube 10*a* is inserted from an opening in the cover 7*b* down to the vicinity of the aforementioned reaction vessel 1 to measure the temperature of the molten salt.

Further, the smelting apparatus of Example 1 is provided with a reduction reaction vessel 11 (a device for supply of raw material) which is made of molybdenum and open in the upper part and contains titanium oxide particles 12; it can be immersed in or pulled out of the molten salt at a place away from the cathode 4 with the anode 3 in between by a hanging line 11*a* and it allows a strongly reducing molten salt containing monovalent calicum ions to flow in from the open end.

The aforementioned anode 3 and cathode 4 are connected to a direct current source 5 and, further, the cathode 4 is connected to the reaction vessel 1 to keep the two at the same electric potential and a decomposition voltage of, say, 2.9 V is applied to the anode 3, cathode 4 and reaction vessel 1.

In Example 1, an observation hole 13 is provided in the cover 7*b* of the airtight vessel 7 for observation of the condition inside the reaction vessel 1 and, in addition, a liquid level sensor 14 is provided in the cover 7*b* to detect the level of the molten salt. The direct current source 5 is connected to the cathode 4 and the reaction vessel 1 in parallel to keep the two at the same electric potential.

Titanium metal can be prepared in the following manner by the use of the smelting apparatus related to Example 1.

First, 950 g of molten calcium chloride ($CaCl_2$) is mixed with 60 g of calcium oxide (CaO) to prepare the reaction region 2 (a calcium chloride bath) consisting of a molten mixture of calcium chloride and calcium oxide.

The anode 3 made of a graphite plate measuring 100 mm×50 mm×15 mm and the cathode 4 made of an iron plate measuring 60 mm×50 mm×5 mm are inserted into this reaction region 2 vertically face to face at an interval of 40 mm and the reduction reaction vessel 11 made of molybdenum and containing 20 g of the titanium oxide particles 12 is immersed in the reaction region 2 in the rear of the cathode 4 (on the opposite side of the anode 3) by means of the hanging line 11*a*.

Then, an atmosphere of inert gas (Ar) is created inside the reaction vessel 1 with the aid of the gas inlet 8*a* and the gas outlet 8*b* of the gas-introducing device 8 and the inside of the reaction vessel 1 is observed through the observation hole 13. The electrolysis is carried out at 900° C. with observable release of the bubbles 15 of CO and $CO_2$ from the vicinity of the anode 3; the monovalent calcium ions ($Ca^+$) and/or calcium (Ca) generated by the electrolysis reduce titanium oxide contained in the reduction reaction vessel 11 and deoxidize the resulting titanium metal.

After 24 hours of continuous electrolysis and reduction/deoxidization, the supply of electric current to the electric furnace heating element 9 is stopped, the reduction reaction vessel 11 is pulled out of the reaction region 2 of the reaction vessel 1, the electric furnace is cooled in this condition, then the reaction vessel 11 is taken out of the airtight vessel 7 and washed successively with water and dilute hydrochloric acid and the titanium metal remaining in the reduction reaction vessel 11 is recovered.

The reduction and deoxidization of titanium oxide by the procedure of Example 1 gave 11.8 g (yield, 98% by weight) of particulate titanium metal with 910 ppm of dissolved oxygen.

EXAMPLE 2

Figure 7:
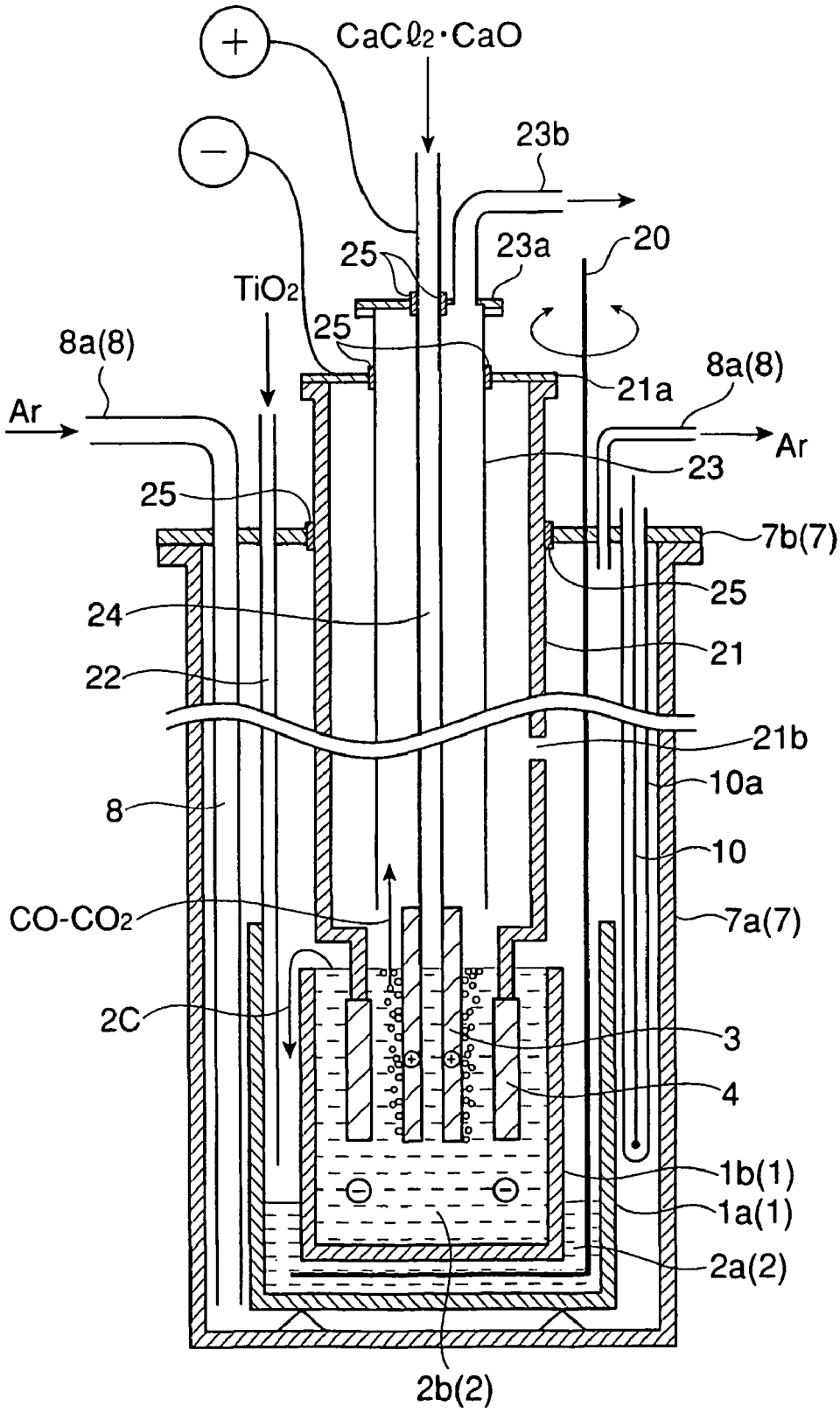
FIG. 7 is a schematic cross section diagram of the apparatus for smelting titanium metal related to Example 2 of this invention.

Continuous reduction of titanium oxide ($TiO_2$) requires continuous supply of calcium chloride ($CaCl_2$) containing calcium (Ca). FIG. 7 is a schematic cross section diagram illustrating in outline the smelting apparatus related to Example 2.

In Example 2, a reaction vessel 1 has a double structure consisting of a reduction reaction vessel 1*a* which is made of iron and relatively large in size and in which the reduction reaction of titanium oxide is carried out and an electrolysis reaction vessel 1*b* which is relatively small in size and placed in the aforementioned reduction reaction vessel 1*a* at a specified interval and in which the electrolysis of a molten salt is carried out. The reaction vessel 1 is put in an airtight vessel 7 consisting of a main body 7*a* made of stainless steel and a cover 7*b* closing an open end at the top.

The aforementioned cover 7*b* is provided with a cathode lead tube 21 which penetrates the center of the cover 7*b* and reaches the molten salt inside the aforementioned electrolysis reaction vessel 1*b* and is connected to a cathode 4 made of iron at the lower end, a gas-introducing device 8 which consists of a gas inlet 8*a* and a gas outlet 8*b*, and a raw material supply tube 22 (a device for supply of raw material) which charges titanium oxide into the aforementioned reduction reaction vessel 1*a*. A cover 21*a* closing an open end at the top of the aforementioned cathode lead tube 21 is provided with an exhaust tube 23 which penetrates the cover 21*a* and reaches above the molten salt in the electrolysis reaction vessel 1*b* and discharges a gaseous mixture of CO and $CO_2$ evolving from a cylindrical graphite anode 3 in the electrolysis reaction vessel 1*b*. Furthermore, a cover 23*a* closing an open end at the top of the exhaust tube 23 is provided with a salt input tube 24 which penetrates the center of the cover 23*a* and reaches above the molten salt constituting the reaction region 2 in the electrolysis reaction vessel 1*b* and charges a mixed salt of calcium chloride and calcium oxide into the electrolysis reaction vessel 1*b* and is further provided with an exhaust pipe 23*b* for discharging the gaseous mixture of CO and $CO_2$. A cylindrical graphite anode 3 is attached to the lower end of the aforementioned salt inlet tube 24 at a specified interval from the aforementioned cathode 4 and the gaseous mixture of CO and $CO_2$ evolving from the anode 3 is led to the exhaust tube 23 and let out from the exhaust pipe 23*b* provided in the cover 23*a*. The cathode lead tube 21 penetrating the cover 7*b*, the exhaust tube 23 penetrating the cover 21*a* of the cathode lead tube 21, and the salt input tube 24 penetrating the cover 23*a* of the exhaust tube 23 are respectively insulated electrically by means of an insulator 25. Moreover, a through hole 21*b* penetrating the side wall of the aforementioned cathode lead tube 21 is provided above the electrolysis reaction vessel 1*b* in the airtight vessel 7.

The aforementioned cover 7*b* is fitted with a thermocouple 10 enclosed in a protective tube 1*a* and with a stirrer 20 which extends down into the molten salt in the reduction reaction vessel 1*a* for stirring the molten salt and the salt input tube 24 having the anode 3 at its lower end and the cathode lead tube 21 having the cathode 4 at its lower end are connected to a direct current source (not shown).

In the smelting apparatus of Example 2, the reaction vessel 1 is divided into the reduction reaction vessel 1*a* and the electrolysis reaction vessel 1*b* and this structure divides the reaction region 2 constituted by the molten salt into a reduction zone 2*a* in the reduction reaction vessel 1*a* and an electrolysis zone 2*b* in the electrolysis reaction vessel 1*b*.

A continuous method for preparing titanium metal by the use of the smelting apparatus of Example 2 is explained below.

First, the air inside the airtight vessel 7 is replaced wholly by argon gas with the aid of the gas-introducing device 8, a mixed salt of calcium chloride and calcium oxide is charged into the electrolysis reaction vessel 1*b* through the salt inlet tube 24 and the electrolysis reaction vessel 1*b* and the reduction reaction vessel 1*a* are kept at a temperature of 900° C. by a heating apparatus (not shown).

Following this, a decomposition voltage is applied between the anode 3 and the cathode 4 by a direct current source (not shown) to effect the electrolysis of calcium chloride and calcium oxide in the electrolysis reaction vessel 1*b*.

Continuous supply of the mixed salt causes the molten salt containing calcium obtained by the electrolysis to overflow the electrolysis reaction vessel 1*b* as an overflow 2*c* and enter the reduction reaction vessel 1*a* which is held in the electrolysis reaction vessel 1*b*.

The molten salt supplied to the reduction reaction vessel 1*a* by the overflow 2*c* from the electrolysis reaction vessel 1*b* is agitated by the stirrer 20 and titanium oxide is continuously supplied from the raw material supply tube 22 to the stirred molten salt to effect the reduction of the titanium oxide and deoxidization of the resulting titanium metal by the monovalent calcium ions ($Ca^+$) and/or calcium (Ca) existing in the molten salt. This operation is conducted continuously for, say, three hours and terminated after accumulation of a specified amount of titanium metal in the reduction reaction vessel 1*a*.

Thereafter, the cooled reduction reaction vessel 1*a* is taken out and immersed in water to elute calcium chloride and the precipitated titanium metal particles are separated from suspended calcium hydroxide, washed with dilute hydrochloride acid, then washed with water and dried to recover titanium metal.

The concentration of dissolved oxygen in the titanium metal particles obtained in Example 2 was 1013 ppm.

EXAMPLE 3

Figure 8:
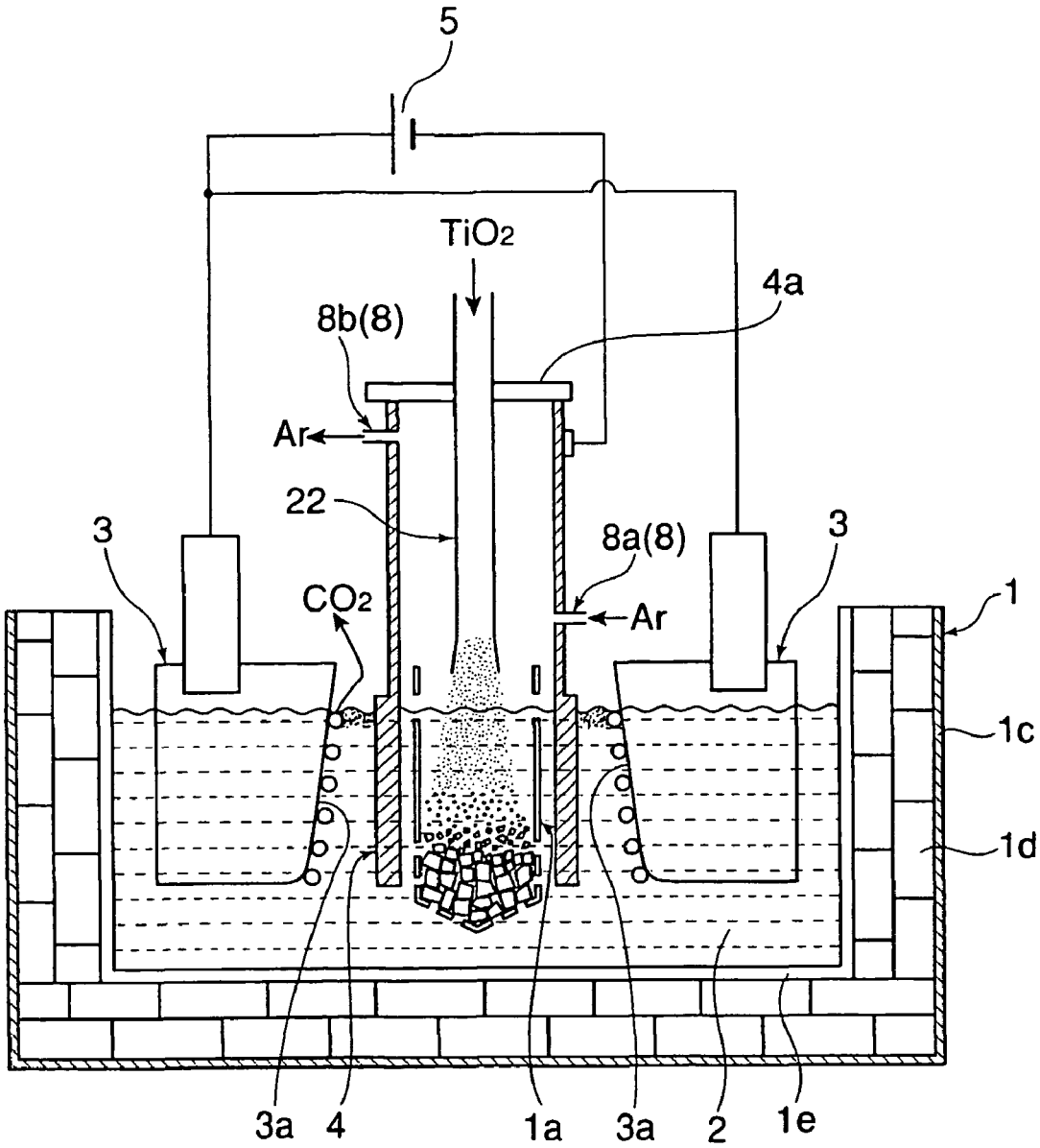
FIG. 8 is a schematic cross section diagram of the apparatus for smelting titanium metal related to Example 3 of this invention.
Figure 9:
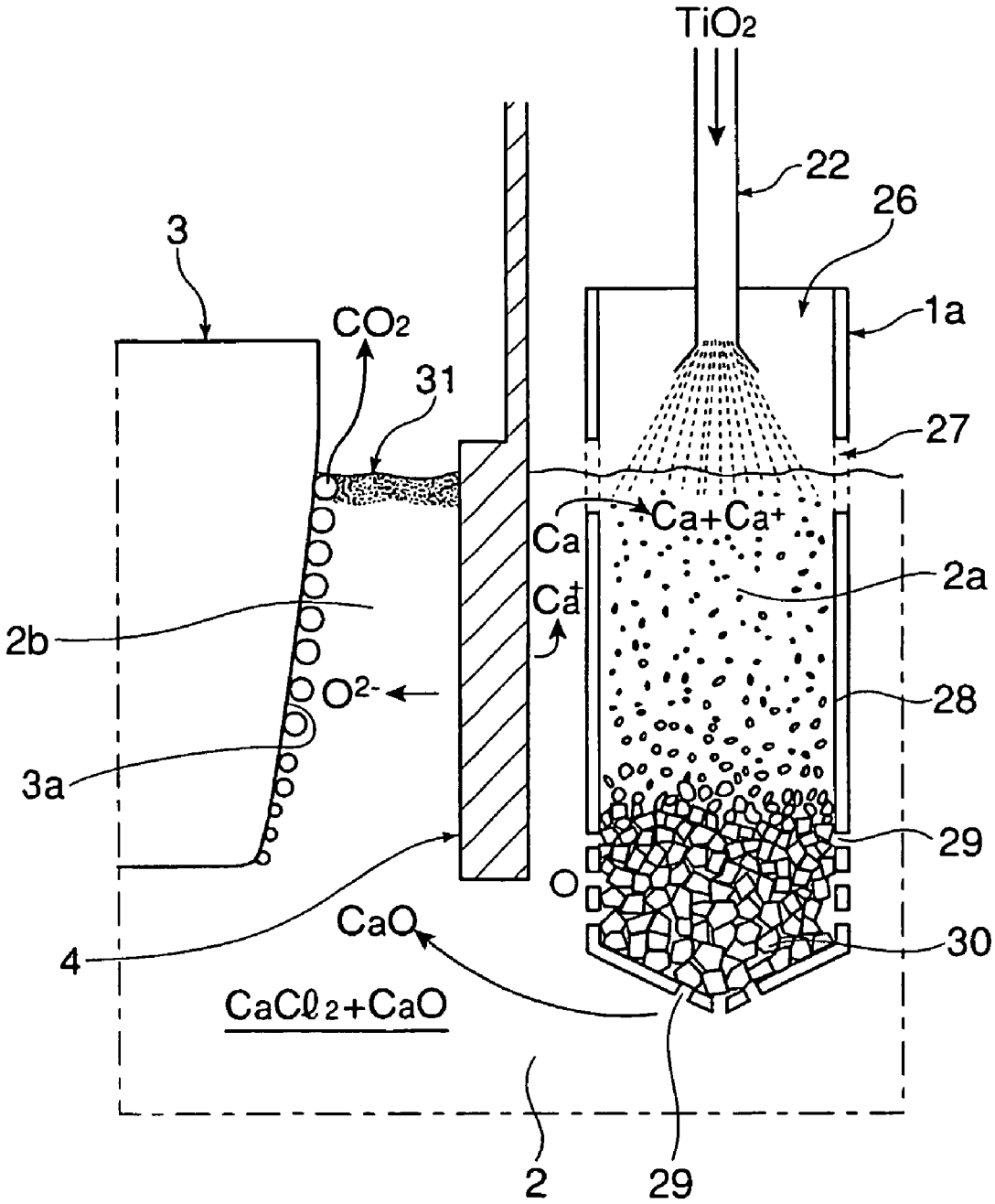
FIG. 9 is a magnification of a part of FIG. 8.

FIGS. 8 and 9 are schematic cross section diagrams of the smelting apparatus of this invention related to Example 3.

In Example 3, the smelting apparatus has a reaction vessel 1 which is a box-shaped steel vessel 1*c* doubly lined with a 200 mm-thick graphite lining 1*d* and a stainless steel lining 1*e* and has an inner space measuring 1 m in length, 0.7 m in width and 1 m in height, an iron cylinder which is provided with a gas-introducing device 8 consisting of a gas inlet 8*a* and a gas outlet 8*b* in the upper part for introducing inert argon gas (Ar) and a cover 4*a* which is electrically insulating and closes an open end at the top and is further provided in the lower periphery with a cathode 4 which is made of titanium metal by cutting up a part of the lower periphery from the bottom upward and has a large number of through holes slanting downward (not shown) at the lower pheriphery, and an anode 3 which is made of a carbonaceous material such as graphite and placed around the cathode 4 with a distance of 55 cm kept between the electrodes. A direct current source 5 for applying a direct current voltage is provided between the anode 3 and the cathode 4.

A reduction reaction vessel 1*a* made of titanium metal is placed inside the lower part of the cylindrical cathode 4; the reduction reaction vessel 1*a* is cylindrical in shape, open at the upper end and put in place with a gap of 5 cm maintained from the surrounding cylindrical cathode 4 and it is provided with a raw material inlet 26 in the upper part for receiving titanium oxide supplied from a raw material supply tube 22 (a device for supply of raw material) which penetrates the center of the cover 4*a* of the cylindrical cathode 4, an inflow hole 27 which is a relatively large through hole formed in the upper wall, and a storing section 28 which has a large number of relatively small through holes or outflow holes 29 on the lower wall and at the bottom. The reduction reaction vessel 1*a* can be pulled out by a device for pulling up and down (not shown).

In Example 3, the aforementioned anode 3 is immersed in the molten mixed salt face to face with the cathode 4 and provided with a slope 3*a*, in the shape of an overhang, at an angle of 5-45 degrees from the vertical direction on the side facing the cathode 4; carbon dioxide ($CO_2$) evolving on the slope 3*a* of the anode 3 rises guided by this overhang. Moreover, it is so designed that an electrolysis zone, 50 cm in width and 60 cm in height in counter area, is formed in the portions of the anode 3 and-the cathode 4 immersed in the molten mixed salt.

In Example 3, a reaction region 2 is formed in the aforementioned reaction vessel 1 by charging 350 kg of a molten salt prepared in advance by heating calcium chloride ($CaCl_2$) containing 5.5% by weight of calcium oxide (CaO) at 1000° C. and the aforementioned cathode 4, functioning as a partition wall, divides the reaction region 2 into an electrolysis zone 2*b* between the anode 3 and the cathode 4 and a reduction zone 2*a* inside the cylindrical cathode 4, particularly inside the reduction reaction vessel 1*a*.

When a direct current voltage in a range not exceeding 3.2 V is applied to the anode 3 and cathode 4 which constitute the aforementioned electrolysis zone 2*b*, carbon dioxide evolving on the slope 3*a* of the anode 3 rises along the slope 3*a* and leaves the reaction region 2 while monovalent calcium ions ($Ca^+$) and also calcium (Ca) generated on the surface of the cathode 4 are trapped in the through holes (not shown) of the cathode 4 and flow into the reduction zone 2*a* inside the cylidrical cathode 4 and the monovalent calcium ions ($Ca^+$) and/or calcium (Ca) further flow through the inflow hole 27 into the upper part of the reduction reaction vessel 1*a*.

When titanium oxide particles with an average particle diameter of 0.5 μm are charged together with argon gas through the raw material supply tube 22 into the reduction zone 2*a* in the raw material inlet 26 of the reduction reaction vessel 1*a* under the aforementioned condition, the titanium oxide is reduced instantaneously by the monovalent calcium ions ($Ca^+$) and/or calcium (Ca) with evolution of heat and the titanium metal particles separated descend through the molten mixed salt in the reduction zone 2*a* while sintering repeatedly and accumulate as titanium metal sponge 30 in the storing section 28 at the bottom of the reduction reaction vessel 1*a*.

The molten salt constituting the reaction region 2 in the reaction vessel 1 generates a gently rising current by the effect of the rising monovalent calcium ions ($Ca^+$) and/or calcium (Ca) in the electrolysis zone 2*b* while the molten salt in the reduction zone 2*a*, particularly in the reduction reaction vessel 1*a*, generates a gently descending current by the effect of the descending titanium metal sponge 30; in FIG. 9 which is a partial magnification of FIG. 8, a current of the molten salt gently flowing in the clockwise direction is generated between the electrolysis zone 2*b* and the reduction zone 2*a*, particularly the reduction reaction vessel 1*a*. Because of this, the current of the molten salt having passed through the storing section 28 of the reduction reaction vessel 1*a* dissolves calcium oxide formed in the reduction of titanium oxide and deoxidization of titanium metal sponge 30 in the reduction zone 2*b* of the reduction reaction vessel 1*a* and transfers this calcium oxide into the electrolysis zone 2*b* through a large number of outflow holes 29 in the storing section 28.

When a given amount of titanium oxide was charged and the titanium metal sponge 30 formed stayed in the molten salt for a given length of time to complete the deoxidization reaction, the reduction reaction vessel 1*a* is pulled up gently by the device for pulling up and down (not shown) and the titanium metal sponge 30 is taken out of the reduction reaction vessel 1*a* and recovered.

In the operation of the reaction vessel 1, a thermal steady state was realized by controlling the decomposition voltage at a value not exceeding 3.2 V and the anode constant current density at 0.6 $A/cm^2$ and, 13 hours after the start of supply of electric current, the reduction reaction vessel 1*a* kept in an atmosphere of argon was immersed in the molten salt.

Titanium oxide with a purity of 99.8% by weight was charged together with argon gas through the raw material supply tube 22 into the reduction reaction vessel 1*a* and sprayed together with the argon gas to the whole surface of the molten salt at a supply rate of 11 g/min. The electrolysis and supply of titanium oxide were continued for 12 hours, the supply of titanium oxide was stopped and, 3 hours thereafter, the reduction reaction vessel 1*a* was pulled up at a rate of 6 cm/min, cooled to 300° C., taken out and allowed to cool to the atmospheric temperature.

In the electrolysis operation, carbon separated from the anode 3 floats and gathers on the surface of the molten salt between the anode 3 and the cathode 4 and this floating concentrated carbon layer 31 is removed intermittently to prevent its thickness from exceeding 10 mm; some of molten calcium chloride accompanies the floating carbon and molten calcium chloride matching in amount to the one going out is replenished from the rear side of the anode 3.

The reduction reaction vessel 1*a* which had been pulled out and cooled to the atmospheric temperature as described above was immersed in water of 5° C. for 10 minutes to separate the titanium metal sponge 30 from the inner surface of the reduction reaction vessel 1*a*, then immersed in a 5 mol % aqueous solution of hydrochloric acid with stirring to remove the salts such as calcium chloride adhering to the surface of titanium metal sponge and the titanium metal sponge 30 was taken out from the reduction reaction vessel 1*a* and dried.

In Example 3, the sum total of titanium oxide supplied to the reduction reaction vessel 1*a* was 8.2 kg and the amount of titanium metal sponge was 4.8 kg and the yield was 96% by weight. The particle diameter of titanium metal sponge ranged widely from 0.2 mm to 30 mm and the sponge sintered relatively loosely and crumbled readily under pressure. Moreover, the impurities or oxygen, carbon, nitrogen, iron and chlorine were determined quantitatively with the following results; oxygen 0.07 wt %, carbon 0.05 wt %, nitrogen 0.01 wt %, iron 0.18 wt % and chlorine 0.16 wt %.

Thereafter, 0.13 kg of the titanium metal sponge was compression molded at 100 kg/cm$^2$ into pellets, 30 mm in diameter and 40 mm in height, with the aid of a compression press (a product of Gonno Co., Ltd.).

The pellets thus obtained were welded together by tungsten inert gas welding (TIG welding) to give an electrode bar, 30 mm in diameter and 150 mm in length, and the electrode bar was subjected to vacuum arc remelting (VAR) and the oxide film formed on the cast skin was cut and removed to give a round bar of titanium.

On the other hand, the pellets obtained above were packed in the cold hearth of an electron beam melting apparatus (a product of ALD Co., Ltd.) and the pellets in the cold hearth were melted by direct irradiation with electron beams or by electron beam melting (EBM) to give a titanium slab.

The impurities in titanium after vacuum arc remelting or electron beam melting were determined quantitatively by micro-gas analysis and emission spectroscopic analysis.

The results are shown in Table 1.

TABLE 1

| | Oxygen | Carbon | Nitrogen | Iron | Chlorine |
|---|---|---|---|---|---|
| VAR (wt %) | 0.01 | 0.06 | 0.01 | 0.08 | 0.04 |
| EBM (wt %) | 0.01 | 0.05 | 0.01 | 0.02 | 0.01 |

EXAMPLE 4

Figure 10:
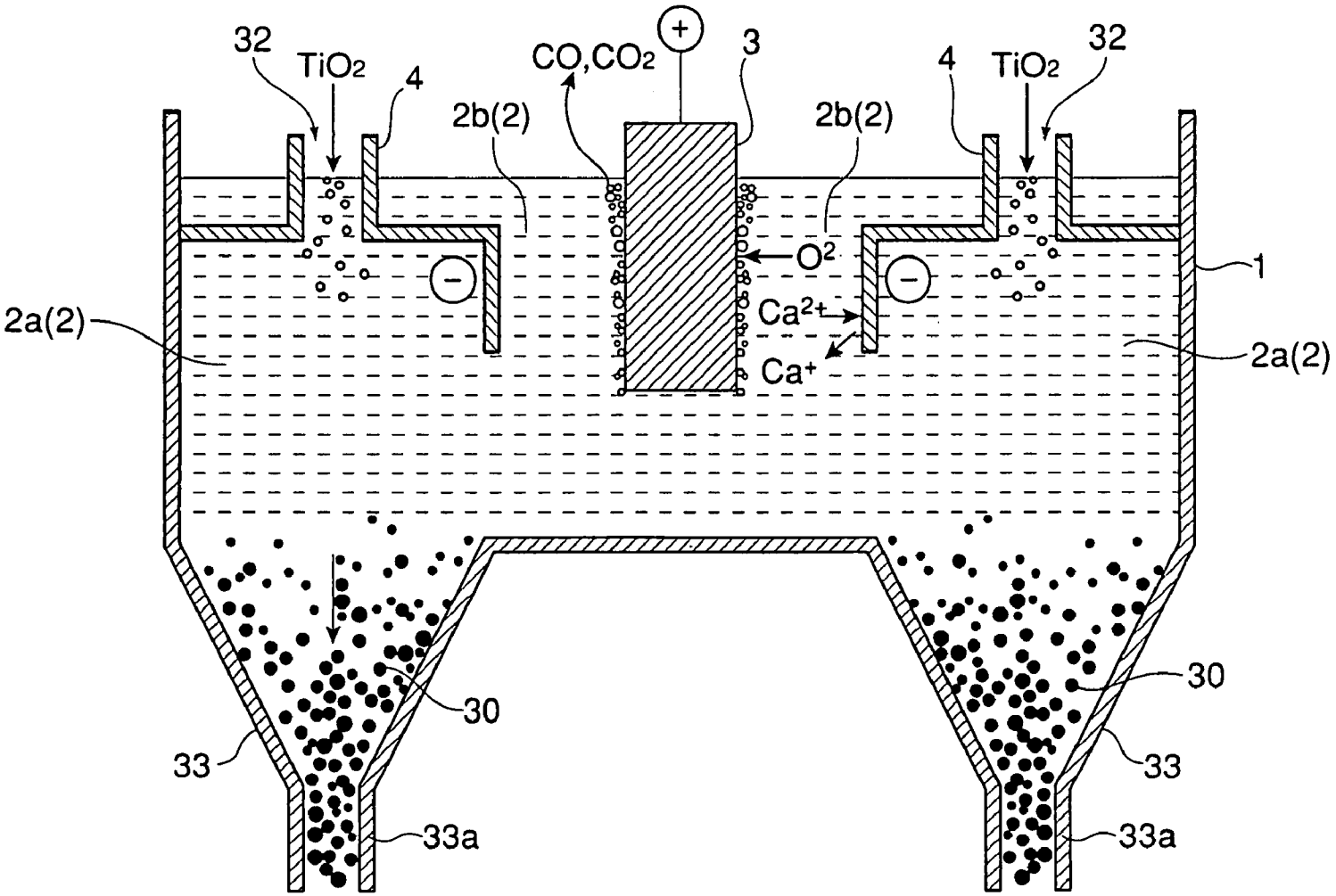
FIG. 10 is a schematic cross section diagram of the apparatus for smelting titanium metal related to Example 4 of this invention.

FIG. 10 illustrates the smelting apparatus related to Example 4 of this invention.

This smelting apparatus differs from that in Example 3: a reaction vessel 1 made of iron contains molten calcium chloride constituting a reaction region 2 and is provided with an anode 3 made of a carbonaceous material such as graphite and a pair of cathodes 4 made of iron and shaped like a crank in cross section, the latter arranged on both sides of the former in the molten salt; cathode 4 respectively divides the reaction region 2 into an electrolysis zone 2*b* existing between the anode 3 and the cathode 4 and a reduction zone 2*a* existing outside the cathode 4 (on the opposite side of the anode 3).

The aforementioned reaction vessel 1 has a raw material supply inlet 32 (a device for supply of raw material) above the respective reduction zone 2*a* and an accumulating zone 33 in which the titanium metal 30 formed accumulates and which has a takeout port 33*a* for the accumulated titanium metal 30 below the respective reduction zone 2*a*.

In the smelting apparatus of Example 4, as in Example 3, titanium oxide supplied from the raw material inlet 32 is reduced to titanium metal 30 by monovalent calcium ions ($Ca^+$) and/or calcium (Ca) generated in the electrolysis zone 2*b*; the titanium metal 30 descends the reduction zone 2*a* and accumulates in the accumulating zone 33 and it is deoxidized in the meantime to attain a specified concentration of dissolved oxygen.

EXAMPLE 5

Figure 11:
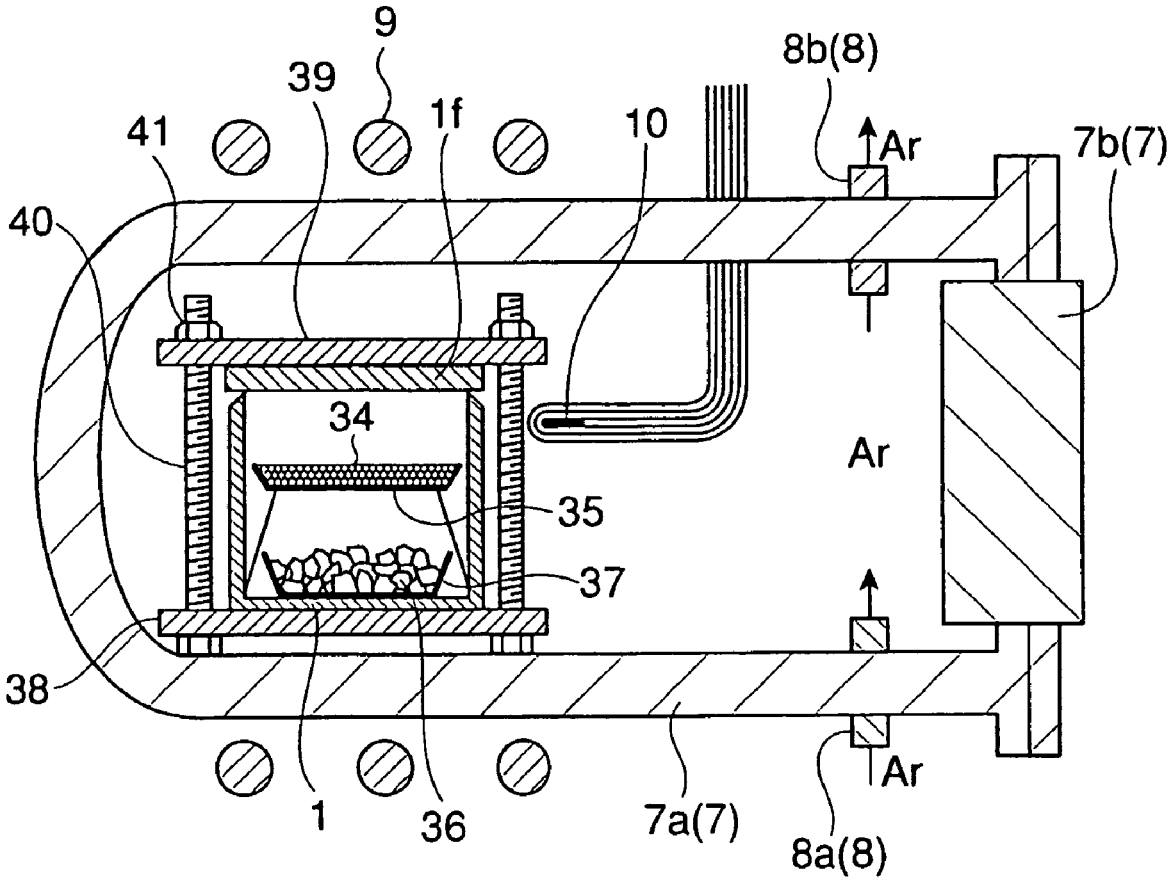
FIG. 11 is a schematic cross section diagram of the apparatus for smelting titanium metal related to Example 5 of this invention.

FIG. 11 illustrates the smelting apparatus related to Example 5 of this invention and it is designed for reducing a mixture 34 of titanium oxide ($TiO_2$) and calcium chloride ($CaCl_2$) by calcium vapor (Ca). The smelting apparatus has an airtight vessel 7, a first reaction dish 35 which holds the mixture 34 of titanium oxide and calcium chloride, a second reaction dish 37 which is placed inside the aforementioned airtight reaction vessel 7 and holds particulate calcium (Ca) 36, a gas-introducing device 8 which consists of a gas inlet 8*a* and a gas outlet 8*b* for letting in and out an inert gas such as argon (Ar) and is used to introduce an inert gas into the airtight vessel 7 in order to maintain the inside of the airtight vessel 7 in an atmosphere of inert gas, and a heating device such as an electric furnace heating element 9 for heating the mixture 34 in the first reaction dish 35 and the particulate calcium 36 in the second reaction dish 37; calcium vapor from molten calcium dissolves in the molten calcium chloride in the mixture 34 to generate monovalent calcium ions ($Ca^+$) and/or calcium (Ca) and titanium oxide in the mixture 34 is reduced and the resulting titanium metal is deoxidized by the monovalent calcium ions and/or calcium.

In Example 5, the first reaction dish 35 is positioned above the second reaction dish 37 and they are placed in the reaction vessel 1 which is made of stainless steel and fitted with a stainless steel cover 1*f*. The reaction vessel 1 is put between a base plate 38 and a top plate 39 and they are screwed tight by a volt 40 and a nut 41 so that the cover if hermetically closes the reaction vessel 1 and the calcium vapor dissolves in the molten salt in the first reaction dish 35 efficiently without dispersing in the whole space of the airtight vessel 7. The edge of the upper open end of the reaction vessel 1 is tapered like a knife edge to enhance the airtightness created by the cover 1*f*.

The aforementioned airtight vessel 7 consists of a main body 7*a* and a cover 7*b* and is equipped with a thermocouple 10 such as an alumel chromel thermocuple to measure the temperature inside, particularly, the temperature in the vicinity of the reaction vessel 1.

As there is no mutual solubility between titanium oxide and calcium chloride at high temperatures, the contents of the first reaction dish 35 separate into two layers, molten calcium chloride (which constitutes the reaction region) forming the upper layer and solid titanium oxide the lower layer, and titanium oxide is completely covered by molten calcium chloride and shut off from the gas phase outside. Calcium vapor evolving from molten calcium (Ca) in the second reaction dish 37 at the bottom fills the reaction vessel 1 and dissolves in molten calcium chloride to reduce titanium oxide and deoxidize the resulting titanium metal.

After the reaction is carried out at a specified temperature for a specified length of time, the furnace is cooled, the reaction product is taken out of the first reaction dish 35, washed successively with water and dilute hydrochloric acid and titanium metal is recovered and dried.

In the experiments conducted in Example 5, an experimental smelting apparatus containing the reaction vessel 1, 50 mm in internal diameter and 80 mm in height, and the airtight vessel 7, 350 mm in internal diameter and 720 mm in length, was constructed; the reduction and deoxidization of titanium oxide were carried out under the conditions shown in Table 2 and the titanium metal obtained was determined for its concentration of dissolved oxygen.

The experimental results are shown in Table 2 together with the conditions for reduction.

TABLE 2

| Experiment No. | | 1 | 2 | 3 |
|---|---|---|---|---|
| Weight of specimen (g) | $TiO_2$ | 4.6 | 4.6 | 4.6 |
| | $CaCl_2$ | 0 | 100 | 100 |
| Reduction temperature (° C.) | | 950 | 950 | 950 |
| Reaction time (hr) | | 24 | 1 | 3 |
| Concentration of dissolved oxygen (wt %) | | 1.883 | 0.127 | 0.085 |

In Experiment No. 1 where titanium oxide was reduced without the use of calcium chloride, titanium metal shows a high concentration of dissolved oxygen in spite of direct reduction of titanium oxide by calcium vapor. On the other hand, in Experiments Nos. 2 and 3 where the reduction and deoxidization were effected by calcium dissolved in calcium chloride, the concentration of dissolved oxygen in titanium metal drops rapidly with the passage of reaction time. A plausible explanation for this difference is as follows: when the reduction is effected in the absence of calcium chloride, calcium oxide formed as a byproduct in the reduction of titanium oxide covers the surface of titanium particles thereby preventing a further intrusion of calcium vapor; whereas, in the presence of molten calcium chloride, the byproduct calcium oxide dissolves in the molten salt without staying around the titanium particles formed by the reduction and the titanium particles come into direct contact with calcium existing in the molten salt thereby allowing the deoxidization reaction to proceed smoothly.

EXAMPLE 6

In continuous smelting of titanium, the titanium metal being formed continuously must be taken out continuously from the reaction vessel 1.

Figure 12:
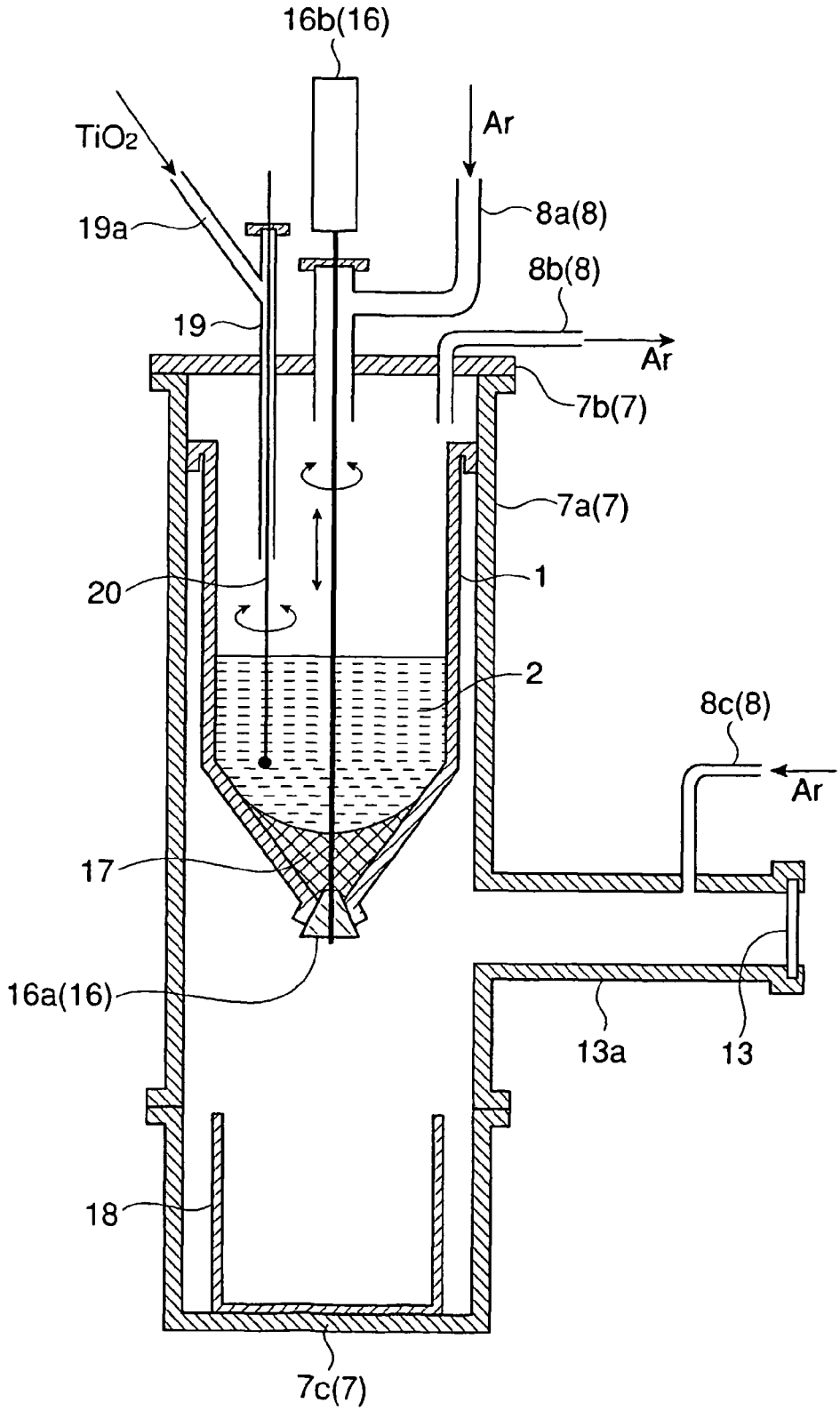
FIG. 12 is a schematic cross section diagram of the apparatus for smelting titanium metal related to Example 6 of this invention.
Figure 13:
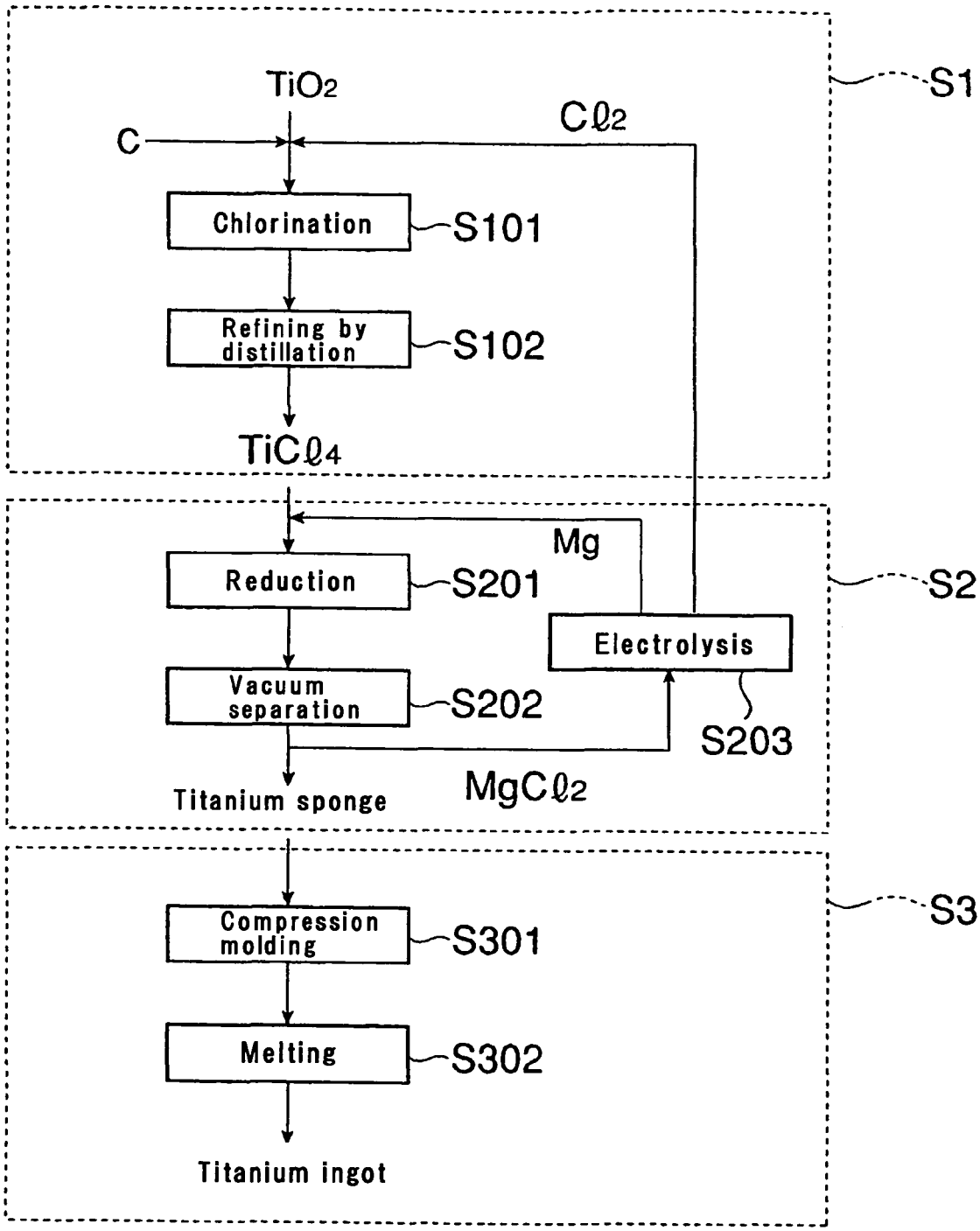
F i g.13 (Prior Art)
FIG. 13 is a flow chart illustrating a method for smelting titanium metal according to the conventional Kroll process.
Figure 14:
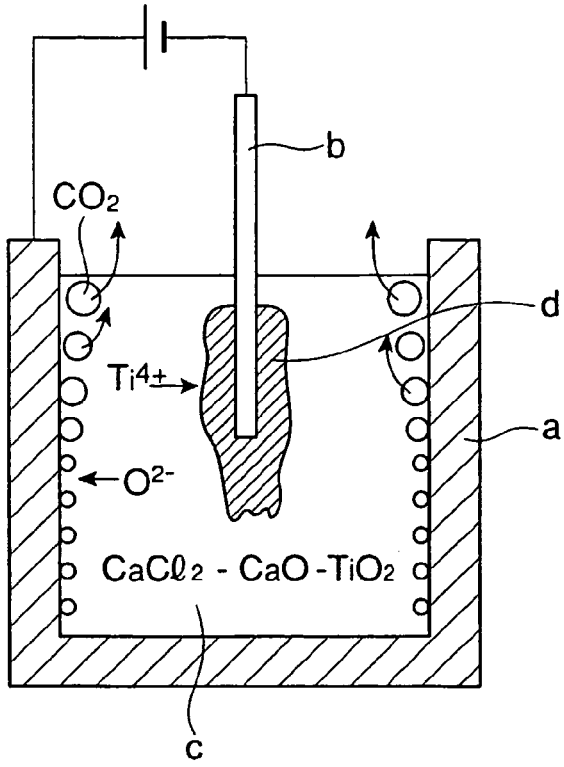
F i g.14 (Prior Art)
FIG. 14 is a schematic cross section diagram of an apparatus according to one of the conventional methods for smelting titanium metal.
Figure 15:
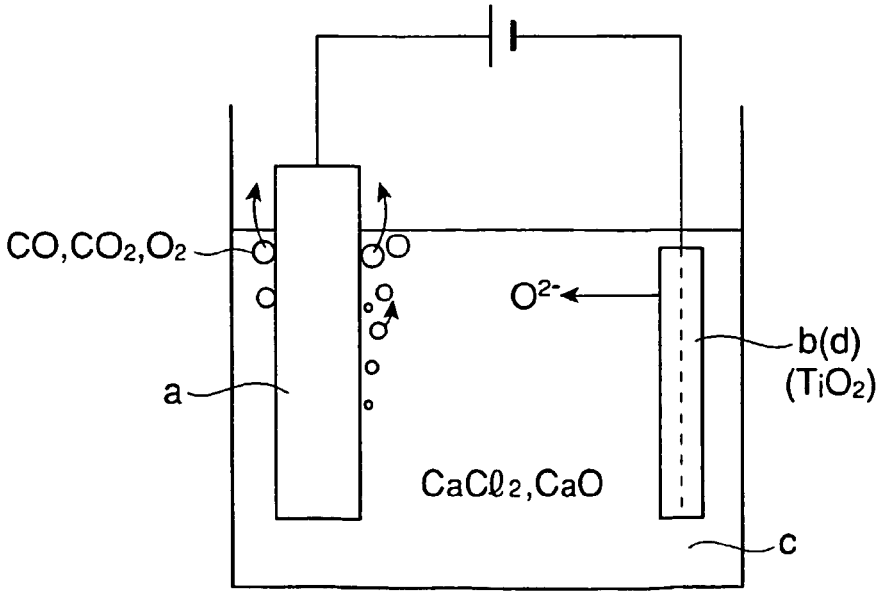
F i g.15 (Prior Art)
FIG. 15 is a schematic cross section diagram of an apparatus according to another of the conventional methods for smelting titanium metal.

In FIG. 12 related to Example 6, a reaction vessel 1 which is made of iron and holds a molten salt constituting a reaction region 2 is provided with a discharge mechanism 16 at the bottom; the discharge mechanism 16 consists of a discharge stopper 16*a* and a stopper drive 16*b* for opening and closing the discharge stopper.

The aforementioned reaction vessel 1 consists of a cylinderical section which is a reduction reaction zone and holds a molten salt constituting the reaction region 2 and a funnel-shaped cone section in which the titanium metal (Ti) formed accumulates and the reaction vessel 1 as a whole is held in an airtight vessel 7. In the reduction reaction zone in the reaction vessel 1, the titanium metal formed by the reduction in the molten salt in the reaction region 2 descends by gravity and accumulates in the cone section of the reaction vessel 1. The titanium metal is subject to continued deoxidization in the cone section and forms a titanium slurry 17. The titanium slurry 17 contains the molten salt and shows flowability as a whole; it descends by gravity, accumulates in the cone section of the reaction vessel 1 and is discharged by the aforementioned discharge mechanism 16.

The aforementioned airtight vessel 7 is wholly made of stainless steel and consists of a main body 7*a* which is open at both upper and lower ends and has an observation hole 13 for observing the condition of the discharge stopper 16*a* of the discharge mechanism 16 provided at the lower end of the cone section of the reaction vessel 1, a cover 7*b* which closes the upper open end of the main body 7*a* and a bottom part 7*c* which is provided at the lower open end of the main body 7*a*.

The aforementioned discharge mechanism 16 is provided above the cover 7*b* of the airtight vessel 7 and the stopper drive 16*b*, either motor-driven or hand-operated, rotates or moves up and down the discharge stopper 16*a* located at the lower end of the cone section of the reaction vessel 1 thereby discharging the titanium slurry 17 down to the lower end of the reaction vessel 1.

The bottom part 7*c* of the aforementioned airtight vessel 7 is provided with a water cooler (not shown) and additionally with a receiver 18 which is made of stainless steel and receives and cools the titanium slurry 17 discharged from the lower end of the cone section of the reaction vessel 1.

An external heater (not shown) capable of heating the reaction vessel 1 and the discharge stopper 16*a* separately and maintaining them at different temperatures is provided around the airtight vessel 7 and the cover 7*b* of the airtight vessel 7 is provided with a raw material supply device 19 for charging titanium oxide particles and a gas-introducing device 8 consisting of a gas inlet 8*a* and a gas outlet 8*b*. Furthermore, a separate gas inlet 8*c* is provided in an installation port 13*a* for the observation hole 13 and, in concert with the gas inlet 8*a*, maintains the whole inside of the airtight vessel 7 in an atmosphere of inert gas such as argon (Ar). Still more, the aforementioned raw material supply device 19 extends down to near the surface of the molten salt of the reaction region 2 and is divided into two Y-shaped branches above the cover 7*b*; a raw material inlet 19*a* is provided at the end of one branch and a stirrer 20 for stirring and dispersing the titanium oxide particles introduced in the molten salt is provided at the end of another branch.

The smelting apparatus related to Example 6 is operated in the following manner.

First, the discharge stopper 16*a* at the bottom of the reaction vessel 1 is closed, argon gas is introduced through the gas inlet 8*a* to the airtight vessel 7 to fill the inside wholly with argon, the reaction vessel 1 is heated by an external heater (not shown) to 900° C. which is above the melting point of calcium chloride and the cone section of the reaction vessel 1 where the titanium slurry 17 accumulates is maintained at 700° C. which is below the melting point of calcium chloride.

Following this, calcium chloride is charged into the reaction vessel 1 through the raw material inlet 19*a* and melted in the reaction vessel 1. The molten calcium chloride solidifies on the wall of the cone section of the reaction vessel 1, but remains molten on the solified layer. After the molten calcium chloride accumulates to a specified amount in this manner, calcium (Ca) is added in a concentration within a range below saturation to form the molten salt constituting the reaction region 2.

After preparation of the molten salt constituting the reaction region 2 in the reaction vessel 1, a specified amount of titanium oxide is continuously added through the raw material inlet 19*a* to the molten salt with stirring by means of the stirrer 20.

Upon completion of the addition, the reaction vessel 1 is held as it is for 10 hours and, after a lapse of this time, the temperature of the cone section in the reaction vessel 1 is gradually raised by the external heater (not shown); when the temperature exceeded the melting point of calcium chloride, the discharge stopper 16*a* is opened by activating the stopper drive 16*b*, the titanium slurry 17 formed by the reduction and deoxidization of titanium oxide is discharged into the receiver 18 below and cooled there.

INDUSTRIAL APPLICABILITY

The method and apparatus of this invention for smelting titanium metal are suitable for mass production with enhanced productivity as they allow facile production of high-purity titanium metal from titanium oxide of a relatively low purity and low price and further allow a continuous operation in charging of the raw material titanium oxide and discharging of the titanium metal formed; furthermore, the concentration of dissolved oxygen in the product titanium metal can be controlled and this allows commercial production of titanium metal suitable for a variety of applications.

What is claimed is:

1. An apparatus for smelting titanium metal which relates to the thermal reduction of titanium oxide ($TiO_2$) to titanium metal (Ti) and comprises a reaction vessel which holds a molten salt consisting of calcium chloride ($CaCl_2$) and calcium oxide (CaO) and constituting a reaction region, an anode and a cathode which are arranged at a specified interval in the reaction vessel and perform the electrolysis of the molten salt, a gas-introducing device for maintaining a part or the whole of the upper part of the reaction region in an atmosphere of inert gas and a raw material supply device for supplying titanium oxide to the reaction region in an atmosphere of inert gas, wherein the reaction vessel is provided with a partitioning device which divides the reaction region into an electrolysis zone where the molten salt is electrolyzed and a reduction zone where titanium oxide is reduced and the resulting titanium metal is deoxidized and allows the monovalent calcium ions ($Ca^+$) and/or calcium (Ca) generated in the electrolysis zone to migrate to the reduction zone and also allows the calcium oxide formed in the reduction zone to migrate to the electrolysis zone, and wherein the partitioning device is a cathode material constituting the cathode confronting the anode in the electrolysis zone.

2. An apparatus for smelting titanium metal as described in claim 1 wherein the partitioning device is a partition wall interposed between the electrolysis zone and the reduction zone.

3. An apparatus for smelting titanium metal as described in claim 1 wherein a reduction reaction vessel which has an opening at the top for supply of titanium oxide and inflow of the monovalent calcium ions and/or calcium generated in the electrolysis zone and can be pulled out of the reduction zone is provided in the reduction zone.

4. An apparatus for smelting titanium metal as described in claim 1 wherein the reaction vessel consists of a reduction reaction vessel which constitutes a reduction zone and an electrolysis reaction vessel which is smaller than the reduction reaction vessel and placed inside the reduction reaction vessel at a specified interval and constitutes an electrolysis zone; in the aforementioned electrolysis reaction vessel, the electrolysis is effected continuously by supplying the molten salt continuously to the electrolysis reaction vessel and the molten salt containing the monovalent calcium ions and/or calcium generated in the electrolysis is allowed to overflow the electrolysis reaction vessel; in the aforementioned reduction reaction vessel, titanium oxide is supplied continuously to the molten salt which has overflowed the electrolysis reaction vessel and accumulated in the reduction reaction vessel and the titanium oxide is reduced and the resulting titanium metal is deoxidized by the monovalent calcium ions and/or calcium in the molten salt.

* * * * *